US011107313B1

(12) United States Patent
Georgilas

(10) Patent No.: US 11,107,313 B1
(45) Date of Patent: Aug. 31, 2021

(54) VIDEO SLOT GAMING SYSTEM AND METHOD OF UTILIZING THE SAME

(71) Applicant: Ahead Gaming, LLC, Las Vegas, NV (US)

(72) Inventor: Justin Tilemahos Georgilas, Las Vegas, NV (US)

( * ) Notice: Subject to any disclaimer, the term of this patent is extended or adjusted under 35 U.S.C. 154(b) by 0 days.

(21) Appl. No.: 16/415,991

(22) Filed: May 17, 2019

(51) Int. Cl.
*G07F 17/34* (2006.01)
*G07F 17/32* (2006.01)

(52) U.S. Cl.
CPC ..... *G07F 17/3213* (2013.01); *G07F 17/3225* (2013.01); *G07F 17/34* (2013.01)

(58) Field of Classification Search
CPC ... G07F 17/3213; G07F 17/3225; G07F 17/34
See application file for complete search history.

(56) References Cited

U.S. PATENT DOCUMENTS

2006/0178207 A1* 8/2006 Bennett ..... G07F 17/32 463/25
2011/0117989 A1* 5/2011 Kennedy ..... G07F 17/34 463/20
2012/0231869 A1* 9/2012 Englman ..... G07F 17/3244 463/20
2015/0141114 A1* 5/2015 Davis ..... G07F 17/34 463/20
2015/0170477 A1* 6/2015 Souza ..... G07F 17/34 463/20
2017/0316651 A1* 11/2017 Wortmann ..... G07F 17/3267
2018/0061176 A1* 3/2018 Berman ..... G07F 17/3244
2018/0122184 A1* 5/2018 Wortmann ..... G07F 17/326
2019/0102976 A1* 4/2019 Halvorson ..... G07F 17/3209
2019/0156630 A1* 5/2019 Cuddy ..... G07F 17/3213

* cited by examiner

*Primary Examiner* — Omkar A Deodhar
*Assistant Examiner* — Shauna-Kay Hall
(74) *Attorney, Agent, or Firm* — FisherBroyles, LLP; Rob L. Phillips

(57) ABSTRACT

A video slot gaming system and method for conducting a slot game incorporating unique bonus games and in-game graphics. A certain number of pre-established symbols appearing on a video screen matrix trigger a bonus game during which a certain number of free spins are undertaken. The primary game reels are used with a modified set of bonus symbols for generating a bonus award. Dynamic multipliers are also used to enhance certain bonus payouts. In addition to the bonus game features, graphics, including animation, serve to enhance the gaming experience for players.

15 Claims, 38 Drawing Sheets

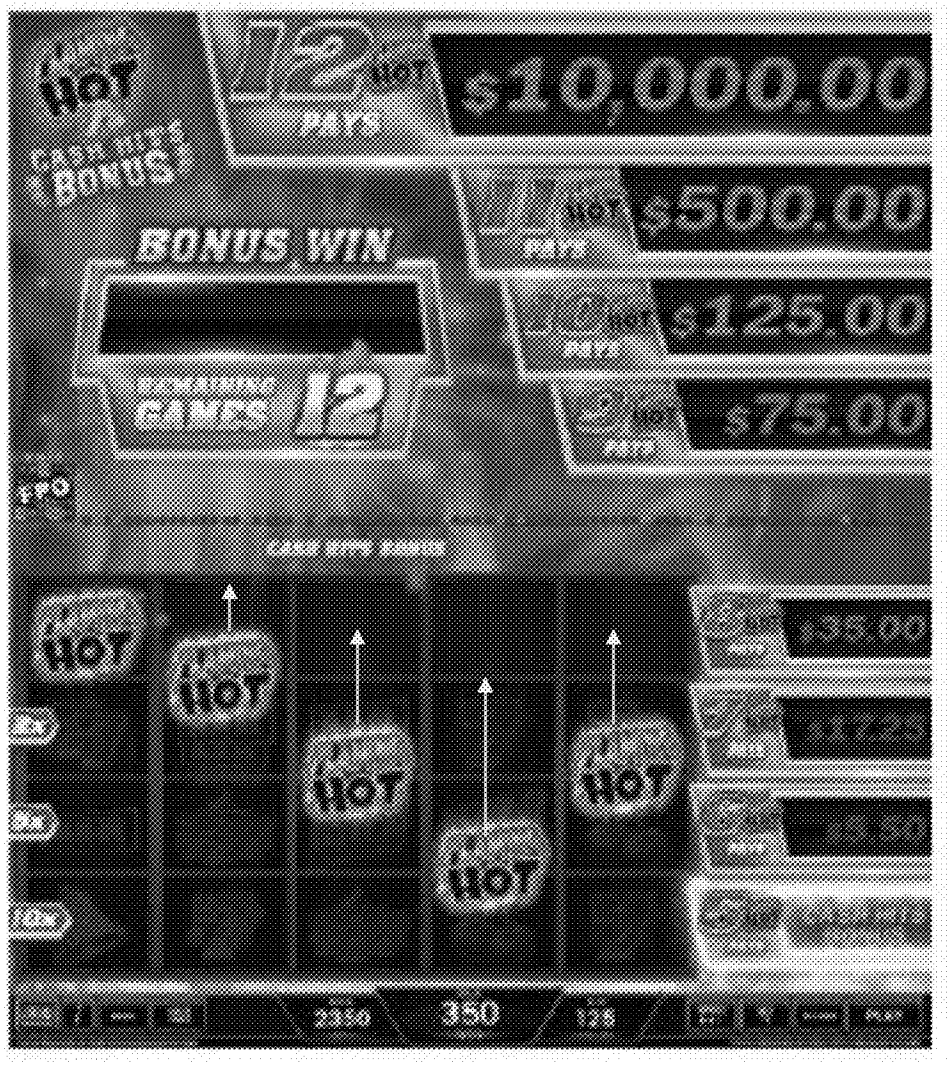
BONUS WIN
21
PLAYS
BONUS
WIN
HOT
HOT
HOT

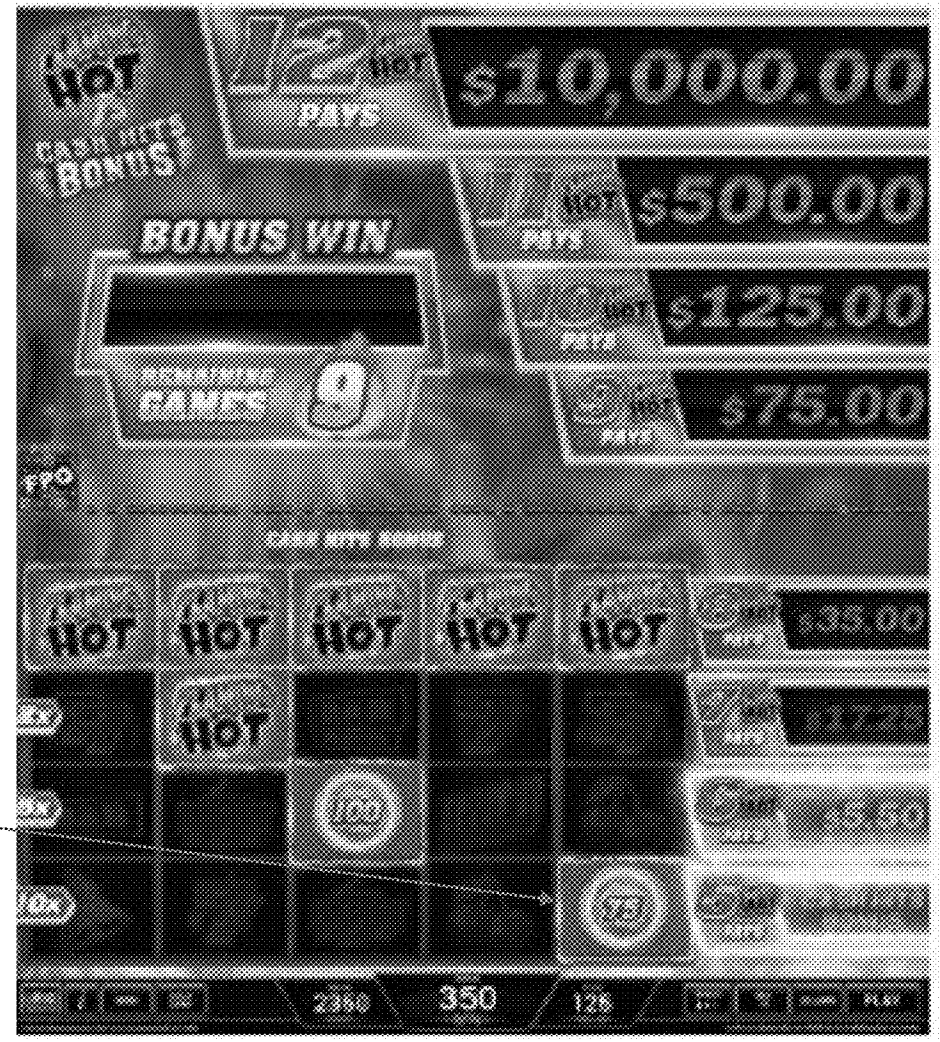
$10,000,000
$500,000
$25,000
$5,000
WIN SUND
BONUS WIN
HOT
HOT
HOT

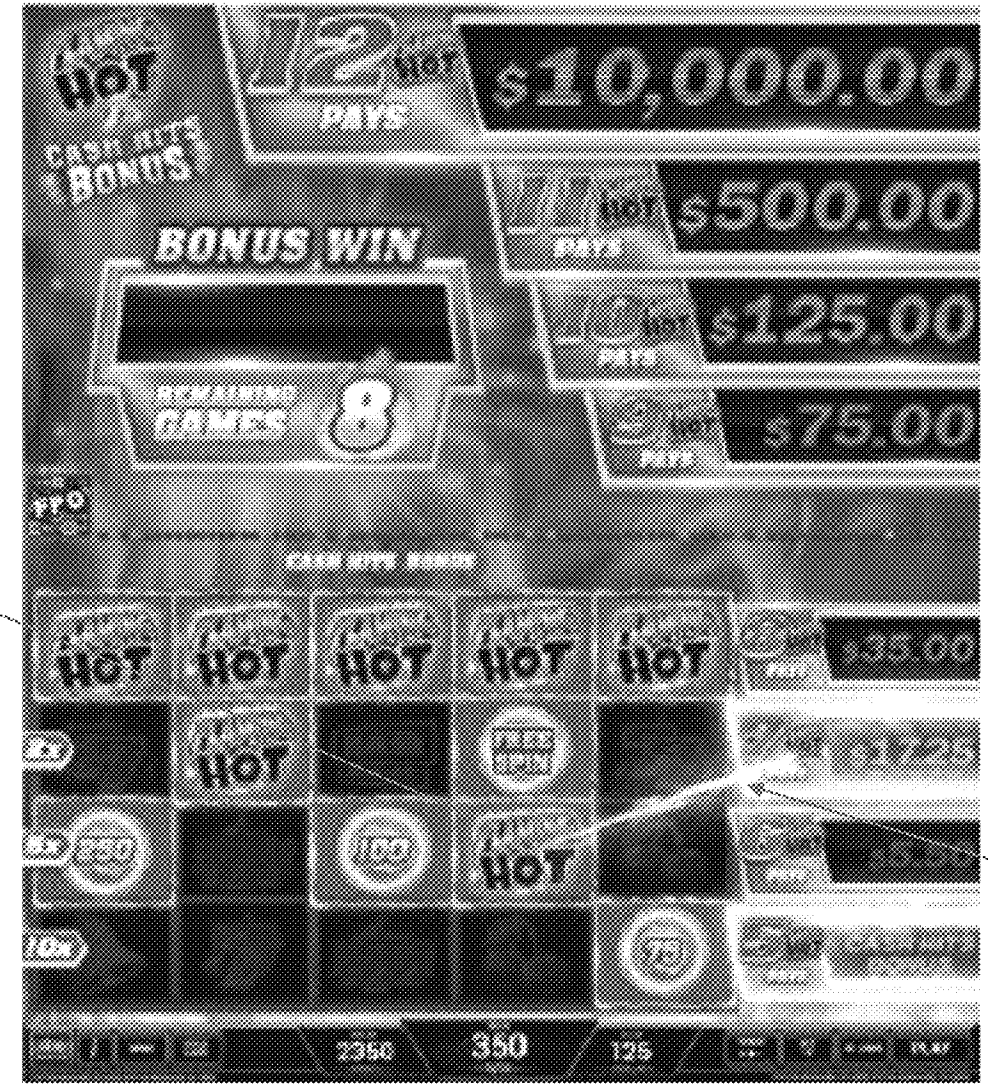
BONUS WIN
HOT
PAY
PAY
PAY

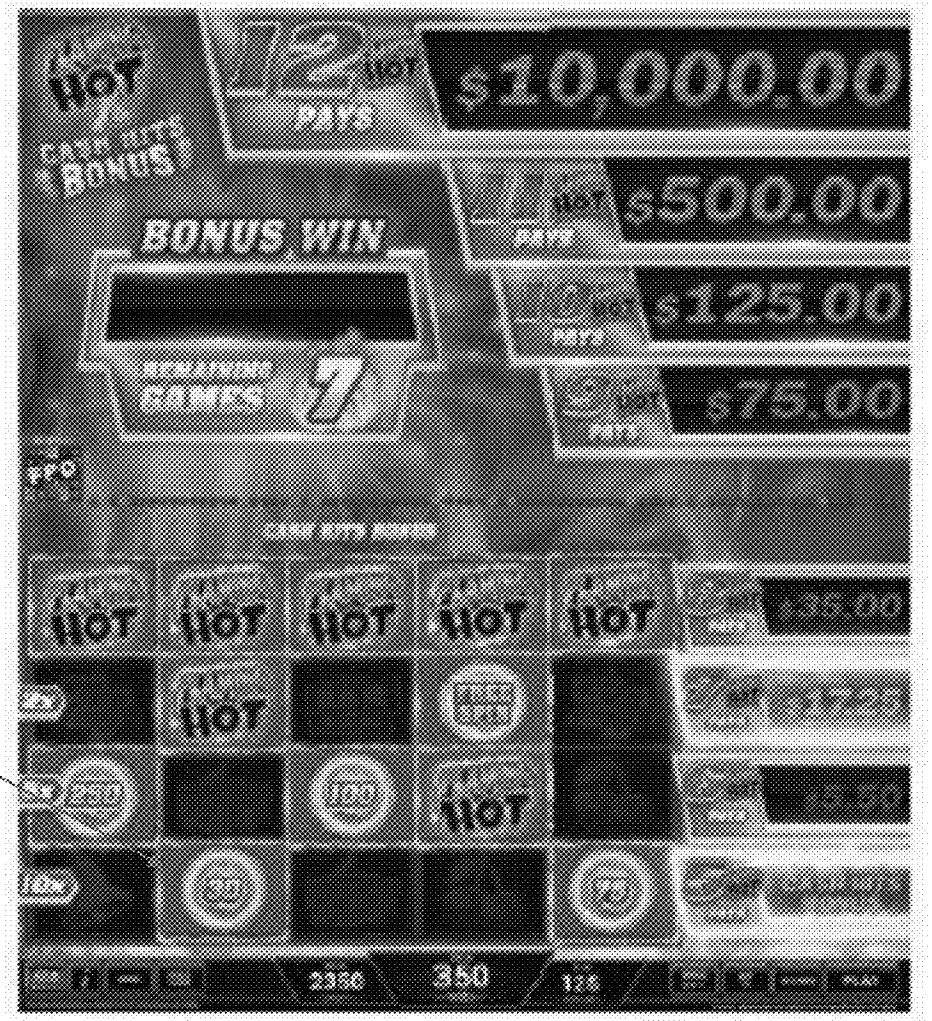
BONUS WIN
$500000
$125000
$25000
$5000
$500
$250
$125
$25
$5
$2
$1
BET
BET
BET

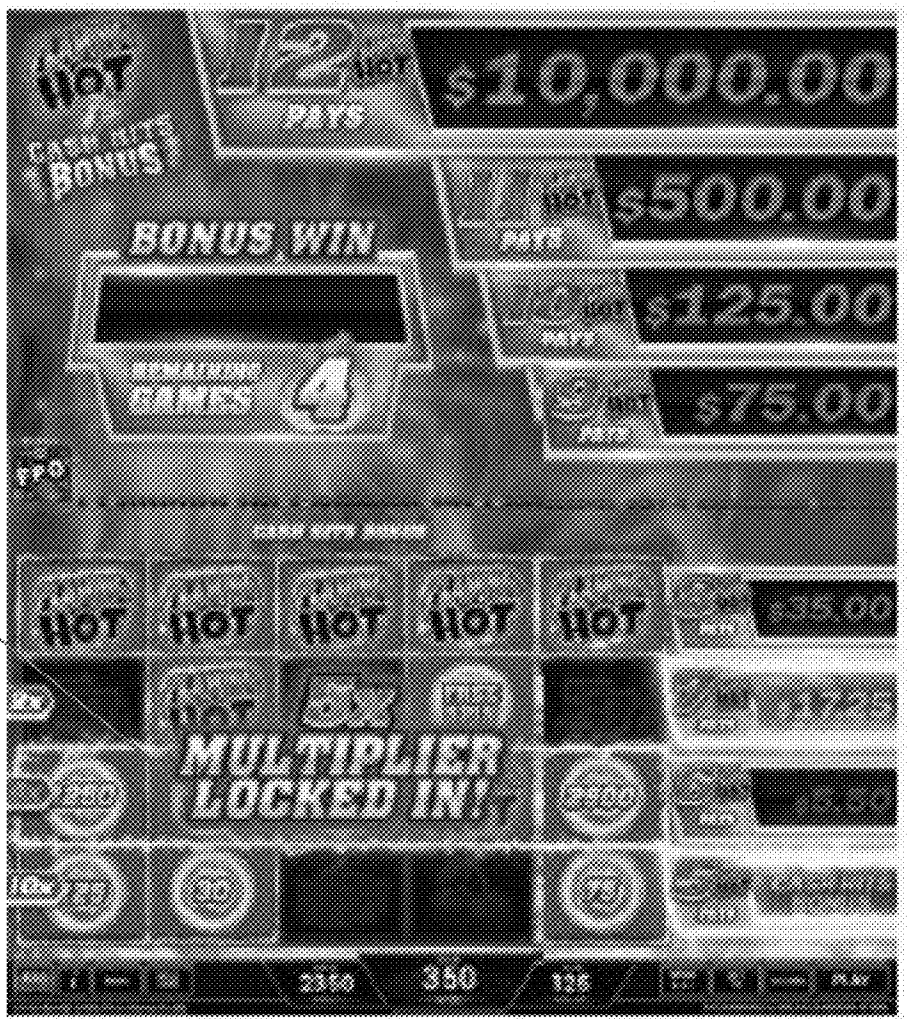
HOT
BONUS WIN
HOT
HOT
HOT

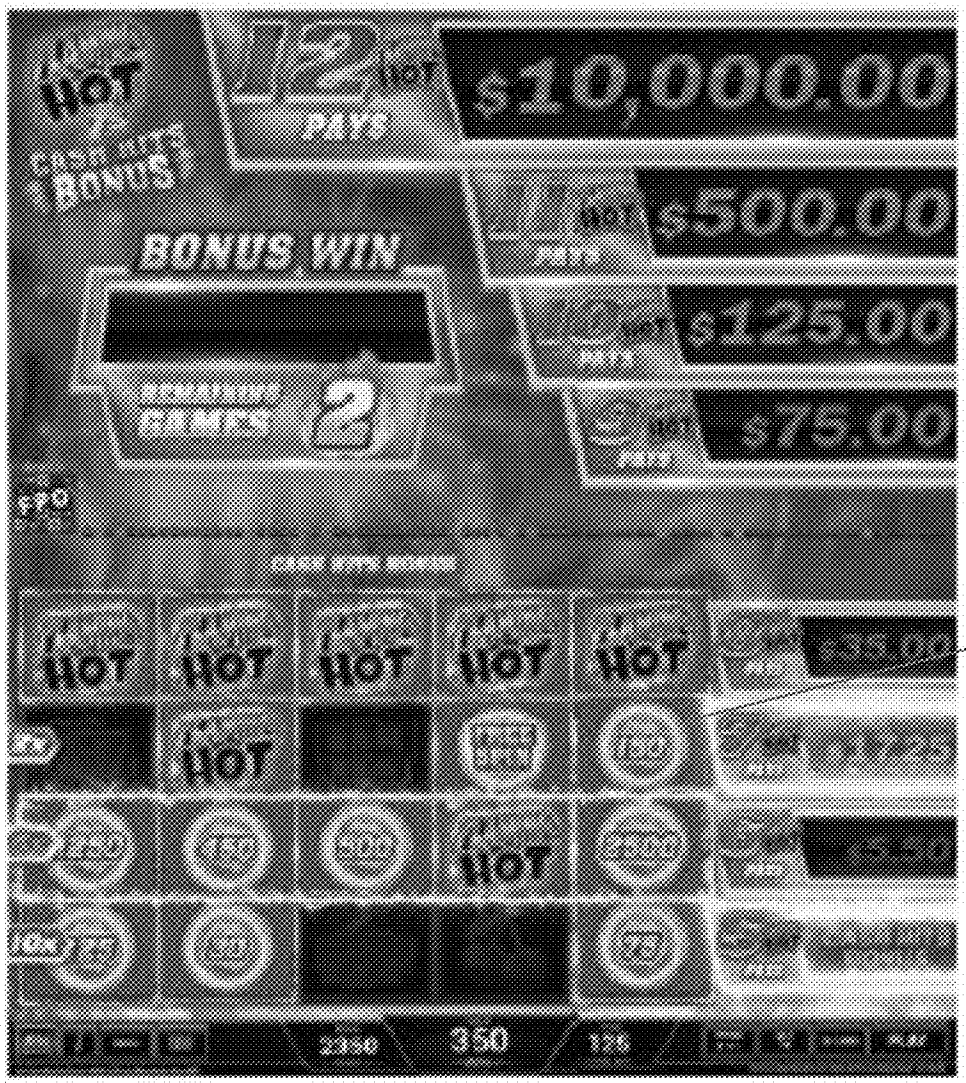
510
HOT
BONUS WIN
BONUS
WIN
00000000
00000000
00000000

520

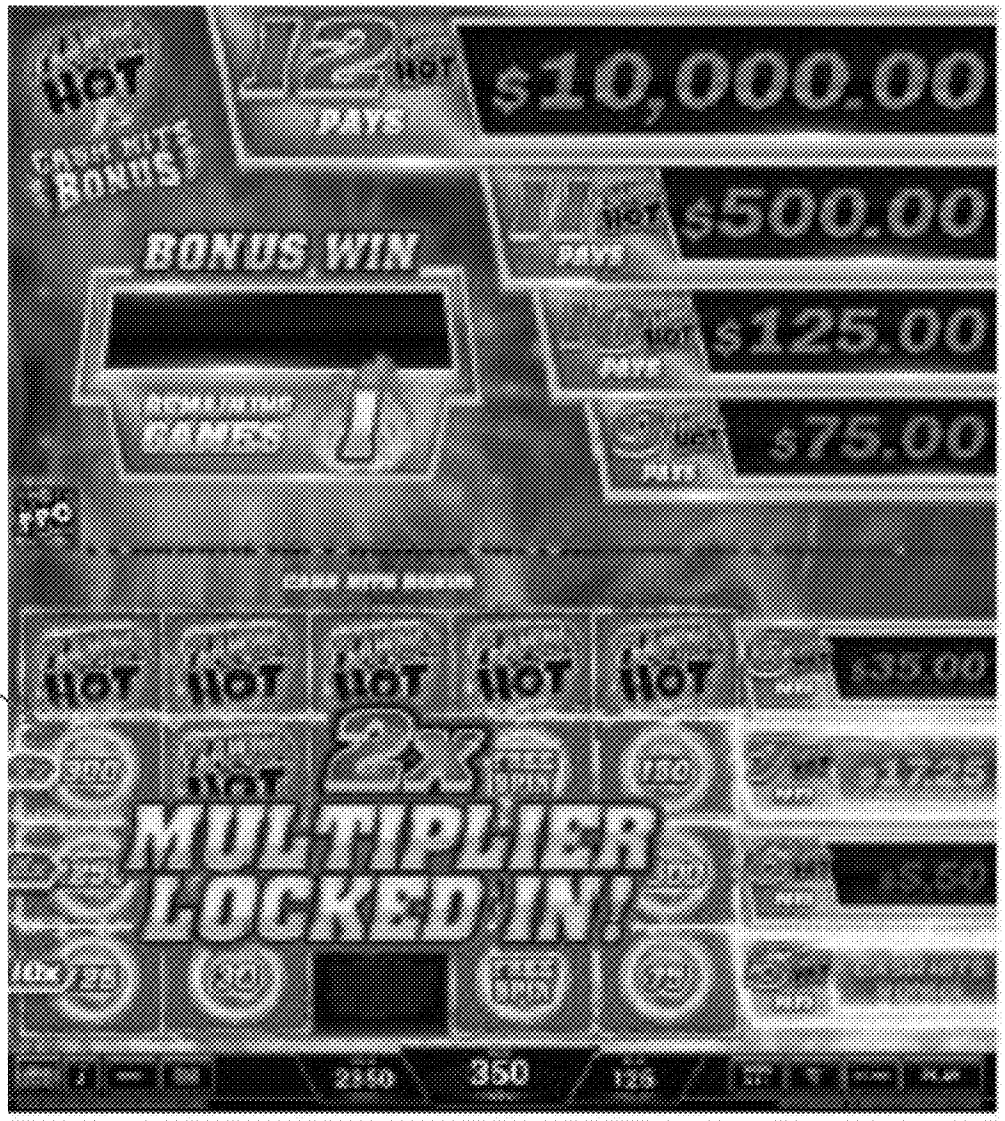
MULTIPLIER
2x
BONUS WIN
SUMMER
HOT
HOT
HOT

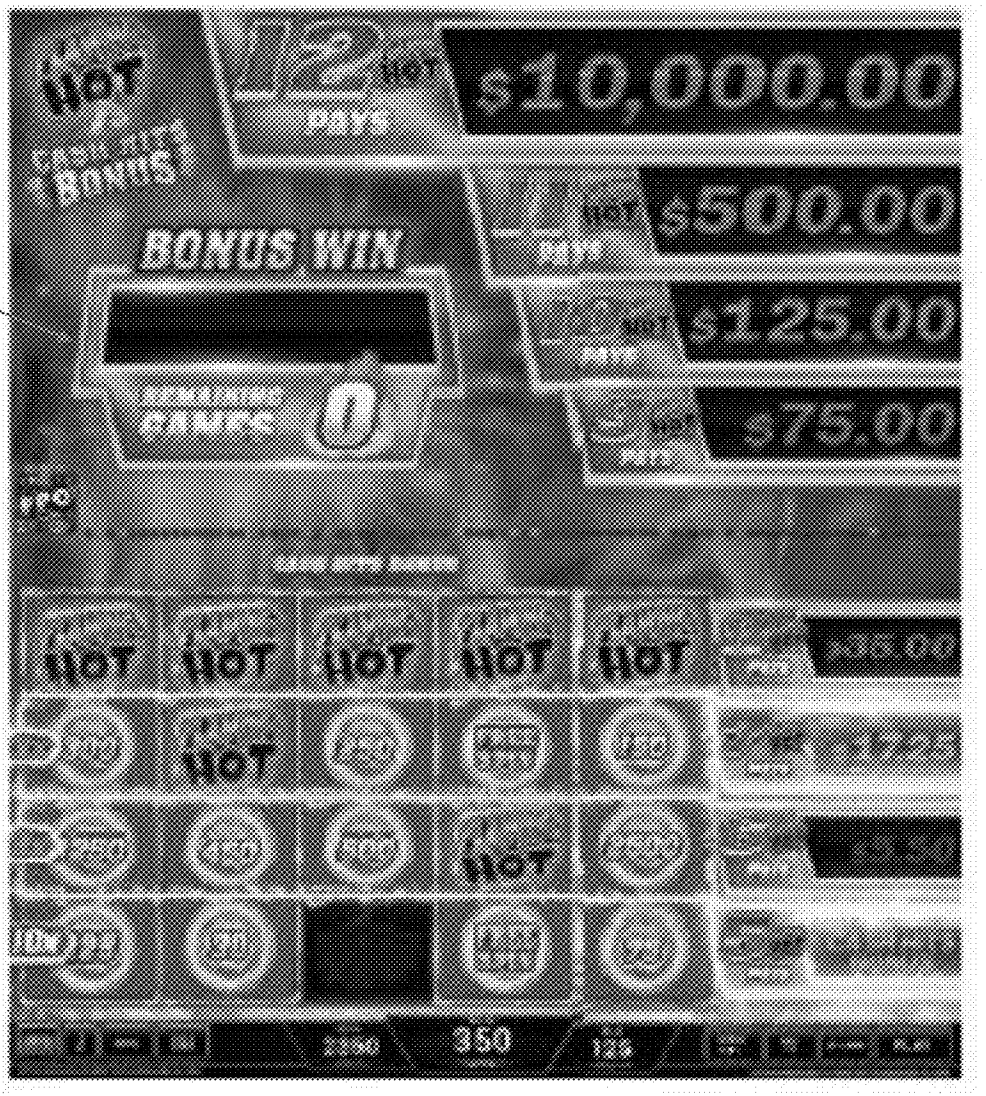
HOT
BONUS WIN
HOT
HOT
HOT

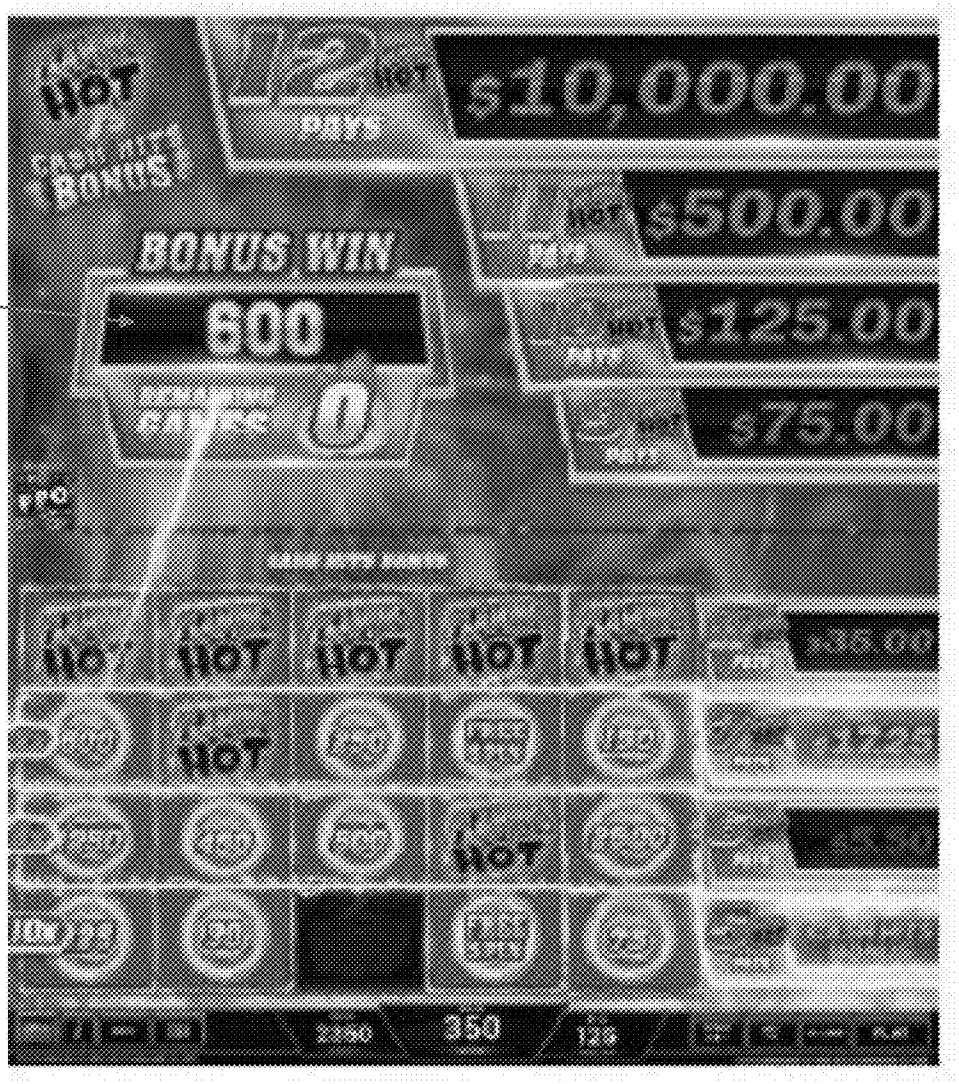
$10,000,000
$500,000
$250,000
$50,000
$25,000
$10,000
$5,000
$2,500
$1,000
$500
$250
$100
$50
$25
$10
$5
$2
$1
BONUS
WIN SYMBOL
600
0
HoT
HoT
HoT

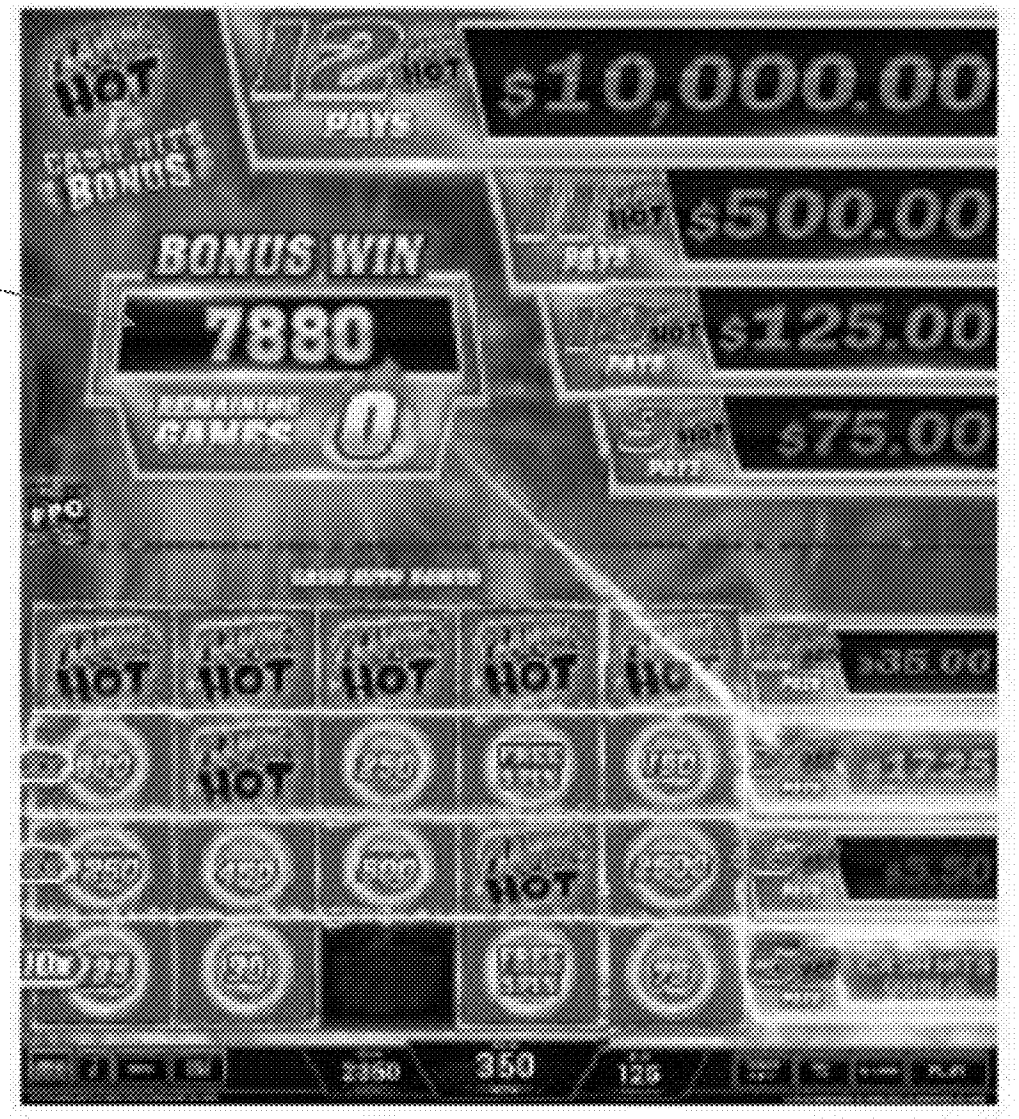
BONUS WIN
7880
HOT
HOT
HOT

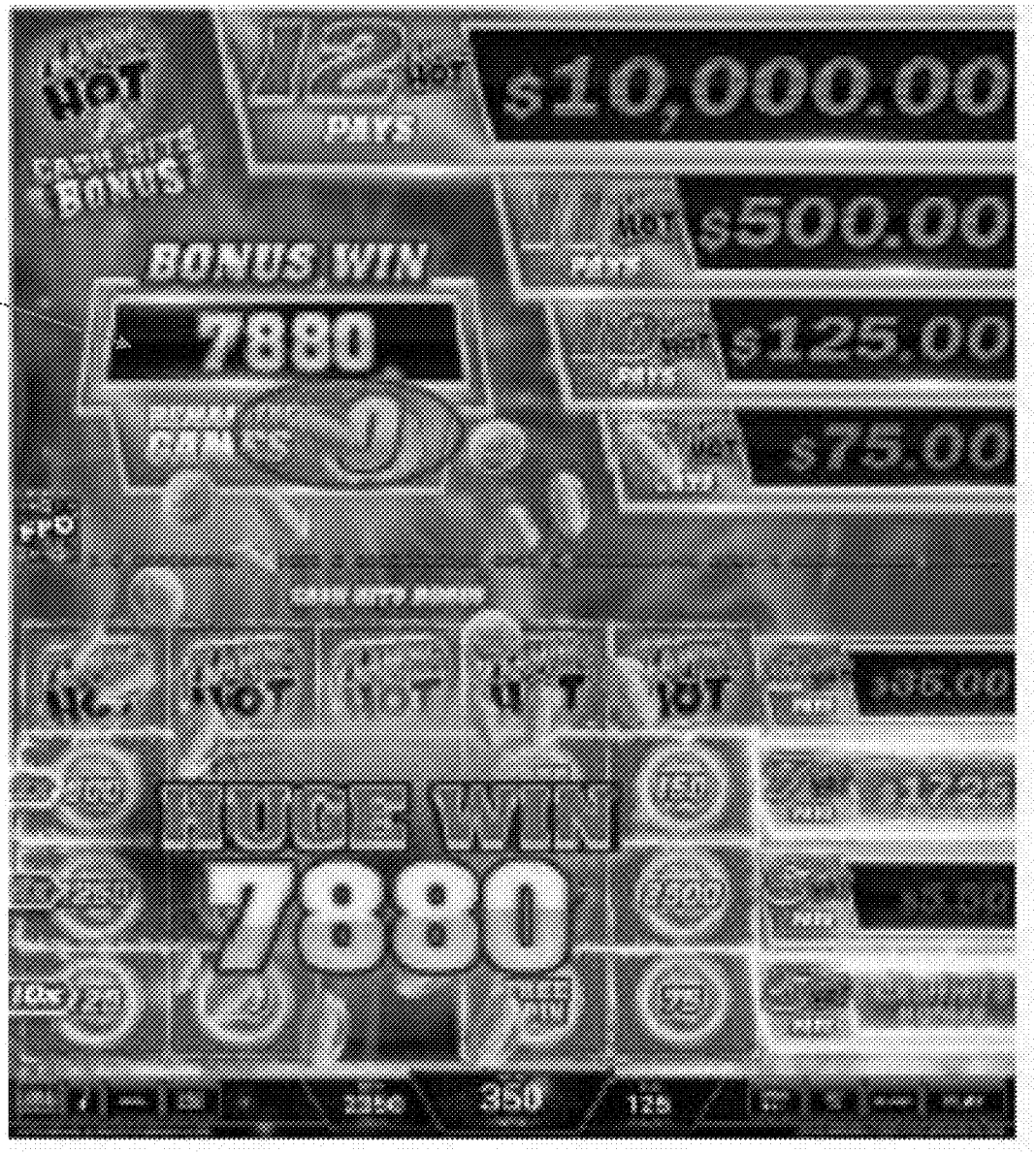
0887
0887
0887

605

640

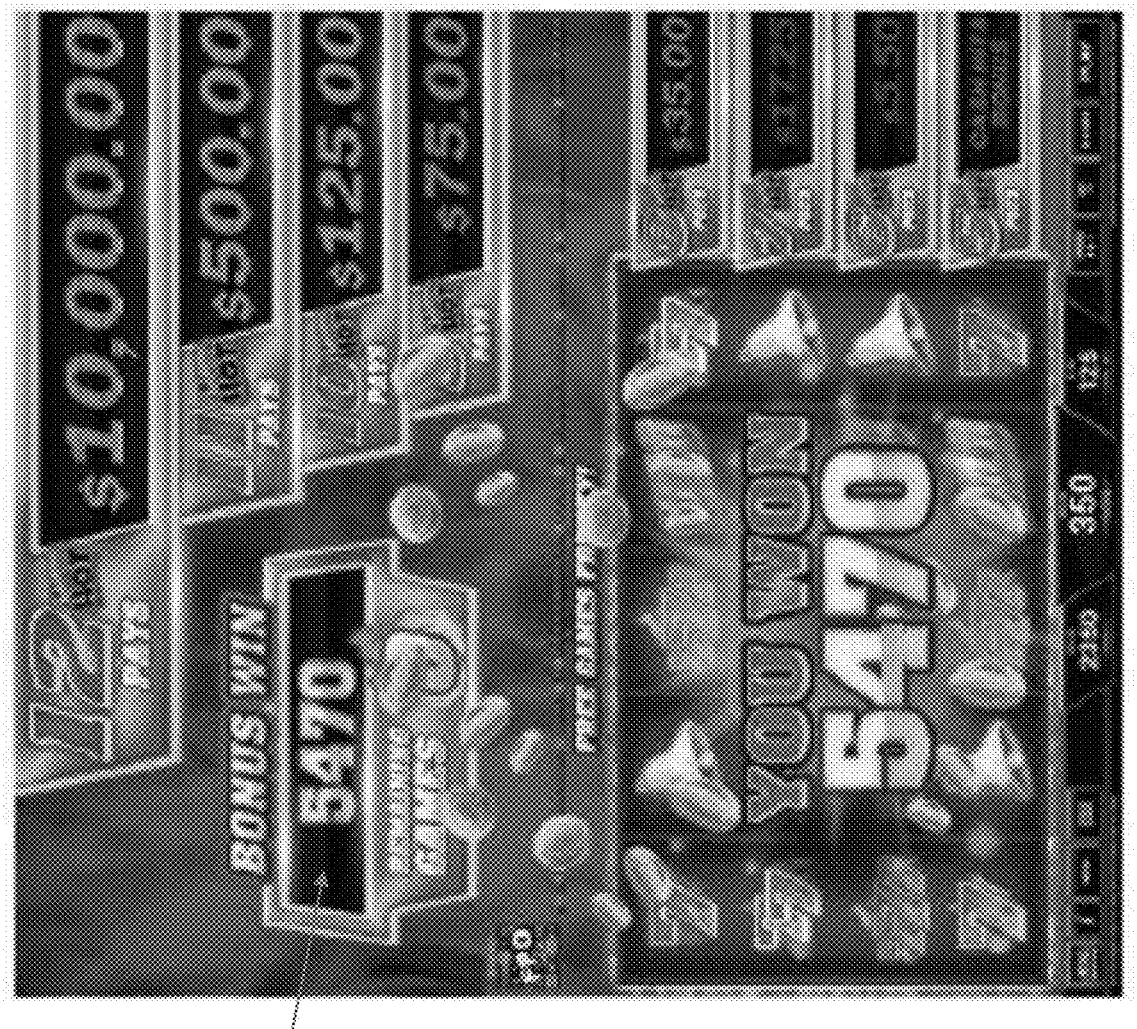
BONUS WIN
$70
$25
$50
$75
$100
$70000000
$50000000
$25000000
$75000000
$100000000
$70
$25
$50
$75
$100
$70000000
$50000000
$25000000
$75000000
$100000000
$0.45
$0.45
$0.45

655

VIDEO SLOT GAMING SYSTEM AND METHOD OF UTILIZING THE SAME

FIELD OF THE INVENTION

The embodiments of the present invention relate to a video slot gaming system incorporating various enhancement features including bonus games.

BACKGROUND

Gaming continues to grow throughout the United States. The primary area of growth in recent years relates to video slot machines and related electronic casino games. Indeed, slot machines occupy a significant percentage of casino gaming floor space.

Thus, it would be advantageous to develop new video slot systems and methods incorporating novel features to attract and retain players.

SUMMARY

The embodiments of the present invention are directed to a video slot gaming system and method for conducting a slot game incorporating unique bonus games and in-game graphics. In one embodiment, a certain number of pre-established symbols appearing on a video screen matrix trigger a bonus game during which a certain number of free spins of the video reels are undertaken. The primary game reels are used with a modified set of bonus symbols for generating a bonus award. Dynamic multipliers are also used to enhance certain bonus payouts. An alternative bonus game first provides a challenge bonus game during which the player wins a number of free spins of the video reels during a successive bonus game.

In addition to the bonus game features, the embodiments of the present invention use graphics, including animation, to enhance the gaming experience for players.

Other variations, embodiments and features of the present invention will become evident from the following detailed description, drawings and claims.

BRIEF DESCRIPTION OF THE DRAWINGS

FIGS. 6A through 6I illustrate a series of screen shots depicting a second bonus game facilitated by the video slot machine according to the embodiments of the present invention;

DETAILED DESCRIPTION

Figure 1:
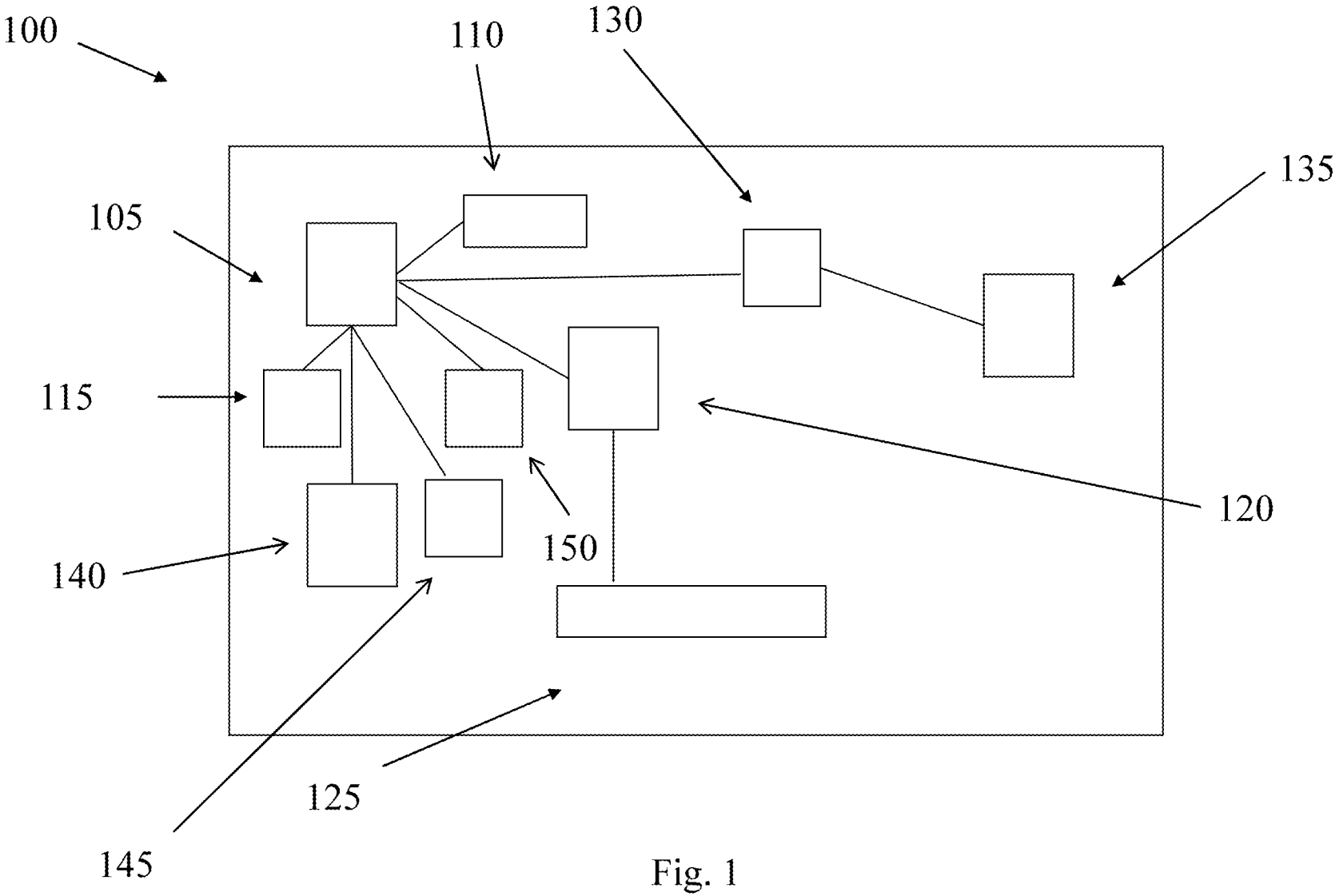
FIG. 1 illustrates a block diagram of components of an electronic gaming device for conducting a game according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Those skilled in the art will recognize that the embodiments of the present invention involve both hardware and software elements which portions are described below in such detail required to construct and operate a game method and system according to the embodiments of the present invention.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.), or an embodiment combining software and hardware. Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), and optical storage device, a magnetic storage device, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied thereon, for example, in baseband or as part of a carrier wave. Such a propagated signal may take any variety of forms, including, but not limited to, electromagnetic, optical, or any suitable combination thereof. A computer readable signal medium may be any computer readable medium that is not a computer readable storage medium and that can communicate, propagate, or transport a program for use by or in conjunction with an instruction execution system, apparatus, or device.

Program code embodied on a computer readable medium may be transmitted using any appropriate medium, including but not limited to wireless, wireline, optical fiber cable, RF and the like, or any suitable combination of the foregoing.

Computer program code for carrying out operations for aspects of the present invention may be written in any combination of one or more programming languages, including an object-oriented programming language such as Java, Smalltalk, C++ or the like or conventional procedural programming languages, such as the "C" programming language, AJAX, PHP, HTML, XHTML, Ruby, CSS or similar programming languages. The programming code may be configured in an application, an operating system, as part of a system firmware, or any suitable combination thereof. The programming code may execute entirely on the user's computer, partly on the user's computer, as a standalone software package, partly on the user's computer and partly on a remote computer or entirely on a remote computer or server as in a client/server relationship sometimes known as cloud computing. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram.

The computer program instructions may also be loaded onto a computer, other programmable data processing apparatus, or other devices to cause a series of operational steps to be performed on the computer, other programmable apparatus or other devices to produce a computer-implemented process such that the instructions which execute on the computer or other programmable apparatus provide processes for implementing the functions/acts specified in the flowchart and/or block diagrams. As used herein, a "gaming device" should be understood to be any one of a general purpose computer, as for example a personal computer or a laptop computer, a client computer configured for interaction with a server, a special purpose computer such as a server, or a smart phone, soft phone, tablet computer, personal digital assistant or any other machine adapted for executing programmable instructions in accordance with the description thereof set forth above.

The embodiments of the present invention may be facilitated by an electronic gaming device whereby a single player plays against the electronic gaming device's (or machine's) processor as described herein. The electronic gaming device may be a standalone device and bar-top device forming part of a gaming device network or not. A block diagram of the electronic gaming device 100 is shown in FIG. 1. The exemplary electronic gaming device 100 may include a central processing unit (CPU) also deemed a processor 105 which controls the electronic gaming device 100 based on instructions stored in program read-only memory (ROM) 110 and pay table ROM 115. Program ROM 110 stores executable instructions related to the operation of the gaming device 100 and which are generally permanent. CPU 105 may be connected to a video controller 120 which provides output to one or more video displays 125. Similarly, an audio controller 130 provides audio output as dictated by the CPU 105 through speakers 135. The aforementioned components, and others, may be attached to a circuit board forming a motherboard. In another embodiment, the electronic gaming device 100 may be linked to a central game server which allows players to select from a number of games via the electronic gaming device 100. In such an embodiment, one or more processors integrated into the central server control the gaming device 100 based on instructions stored in program ROM 110.

A user interface 140 may respond to buttons on button panel or display incorporating touch screen technology or any other devices providing means for users to communicate with, and instruct, the electronic gaming device 100. Wager memory 145 stores an amount of money/credits deposited into the electronic gaming device 100 by a player and specific wager information related to each play of the electronic gaming device 100. Payout system 150 includes a coupon printer or similar device for receiving money/coupon from the electronic gaming device 100.

Those skilled in the art will recognize that the configuration and features of the electronic gaming device 100 disclosed herein are exemplary and may be altered in any number of ways without impacting the embodiments of the present invention.

Figure 2:
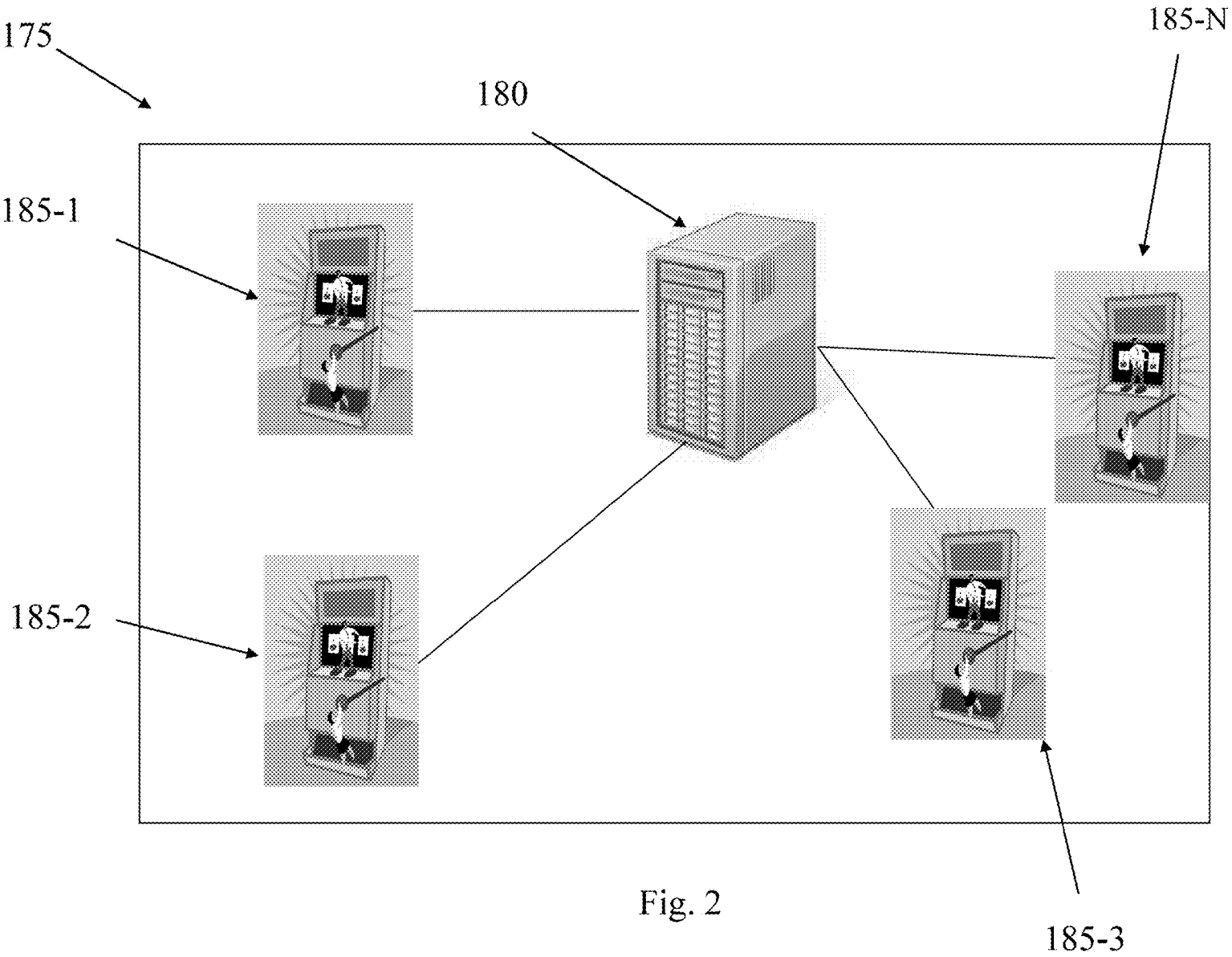
FIG. 2 illustrates a block diagram of a wireless network system including numerous slot machines according to the embodiments of the present invention.

FIG. 2 shows a block diagram of a gaming network 175 which may be used to facilitate play of the game via linked gaming devices according to the embodiments of the present invention. The gaming network 175 comprises a central processor 180 (e.g., processor-equipped game server) in communication with multiple gaming devices 185-1 through 185-N as described in FIG. 1.

Figure 3:
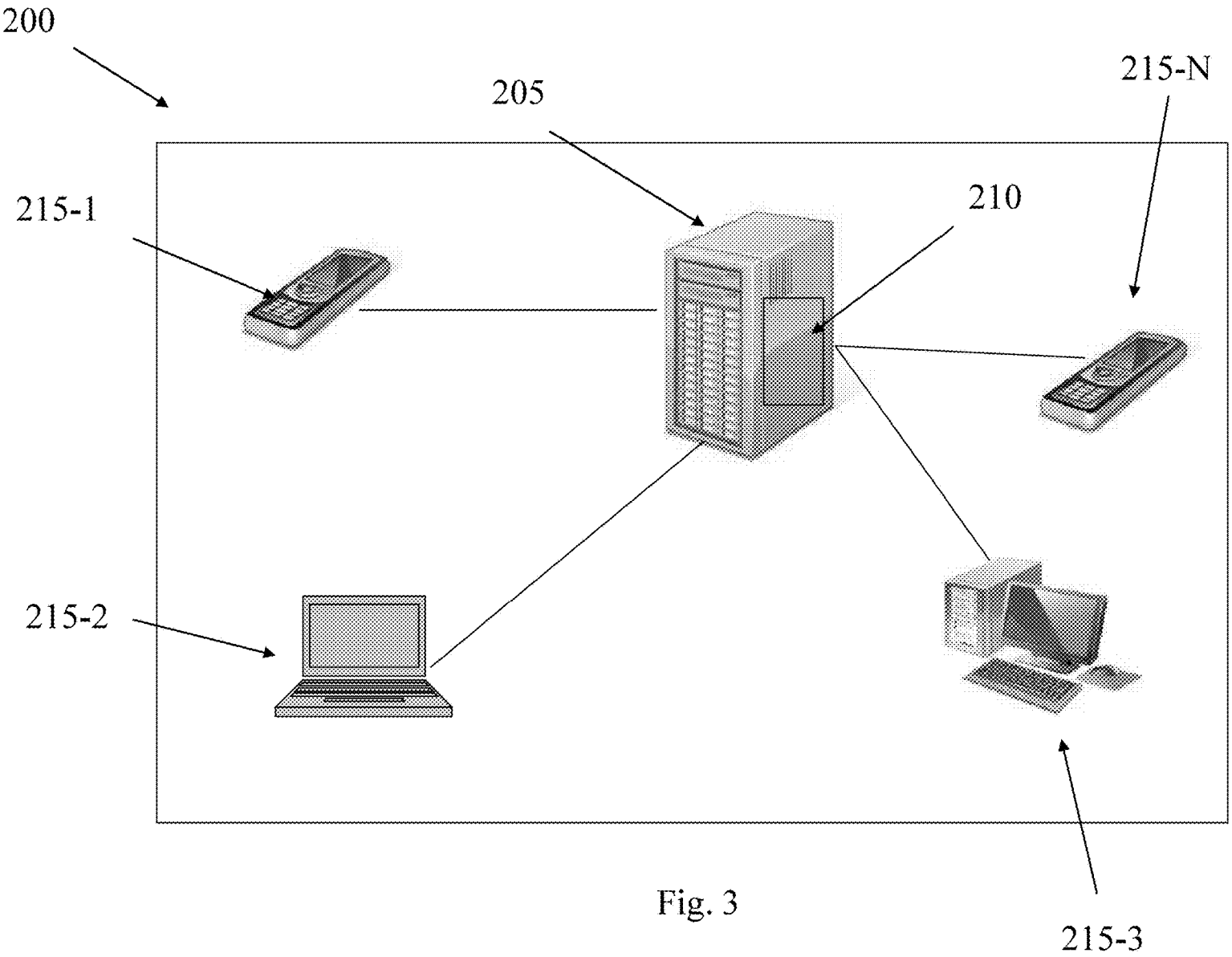
FIG. 3 illustrates a block diagram of a wireless network system accessible by mobile devices for conducting mobile games of chance according to the embodiments of the present invention.

FIG. 3 shows a block diagram of a wireless system 200 which may be used to facilitate remote play of the game according to the embodiments of the present invention. The wireless network system 200 comprises a processor-equipped game server 205, including one or more processors 210 running game software, and remote devices 215-1 through 215-N (e.g., smart phones) configured to access said game server 205 facilitating game play on the remote devices 215-1 through 215-N. In another embodiment, the video game according to the embodiments of the present invention may be in the form of a software application ("App") downloadable onto smart phones, tablets or computers and playable via processing power and a user interface associated therewith.

The detailed description below focuses on a slot game based on an exemplary "Flaming Hot 7*s*" theme. Those skilled in the art will recognize that the system and method disclosed herein can be integrated into a slot game based on any theme and is in no way limited to the exemplary "Flaming Hot 7*s*" theme.

Figure 4:
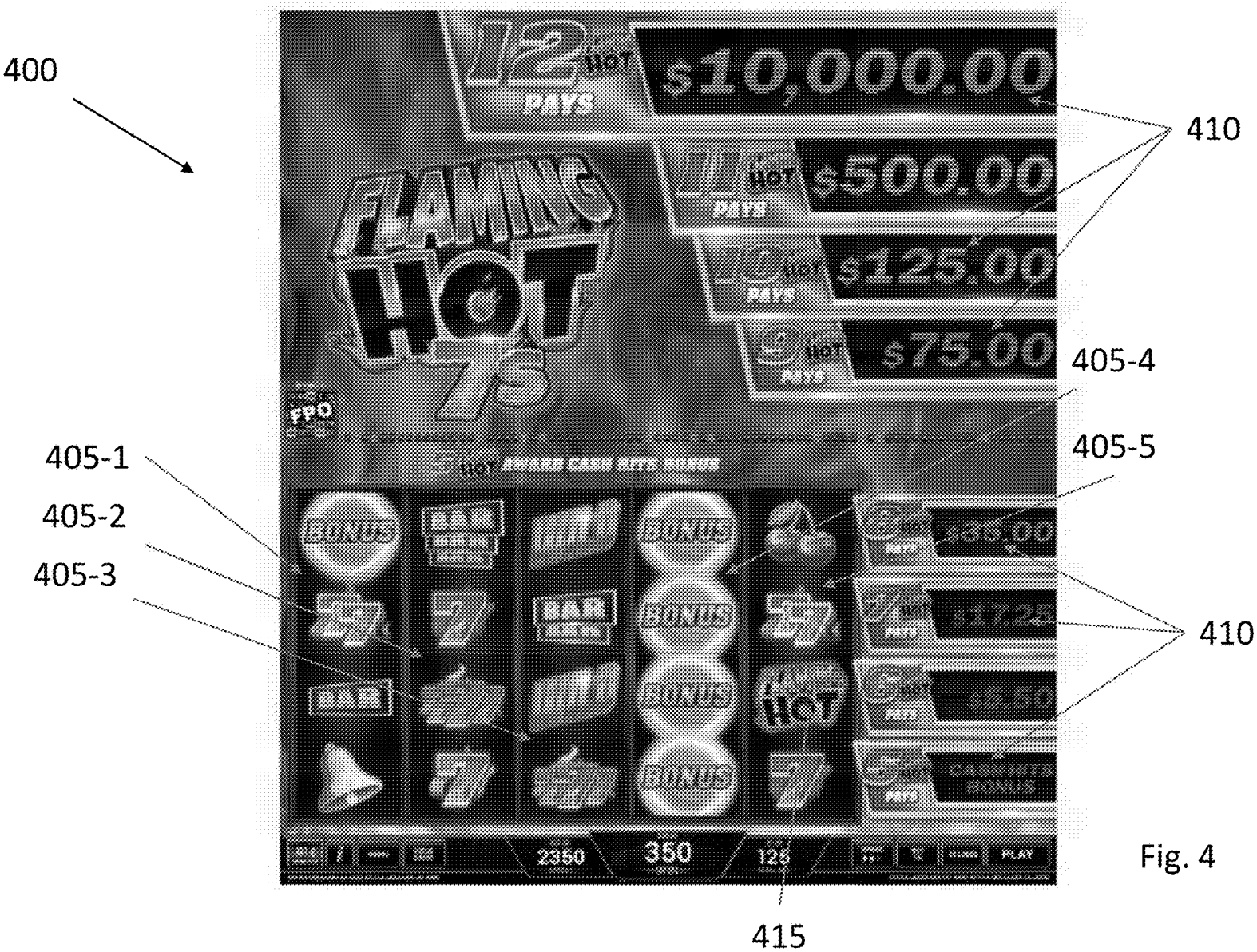
FIG. 4 illustrates an exemplary home screen shot of a video slot machine according to the embodiments of the present invention.

FIG. 4 illustrates an exemplary home screen shot 400 of a video slot machine according to the embodiments of the present invention. As shown, the video slot machine depicts a 5-reeled 405-1 through 405-5 slot game. A series of payouts 410 related to a number of "Flaming Hot" symbols 415 appearing across all five reels 405-1 through 405-5 is displayed on the home screen.

Figure 5A:
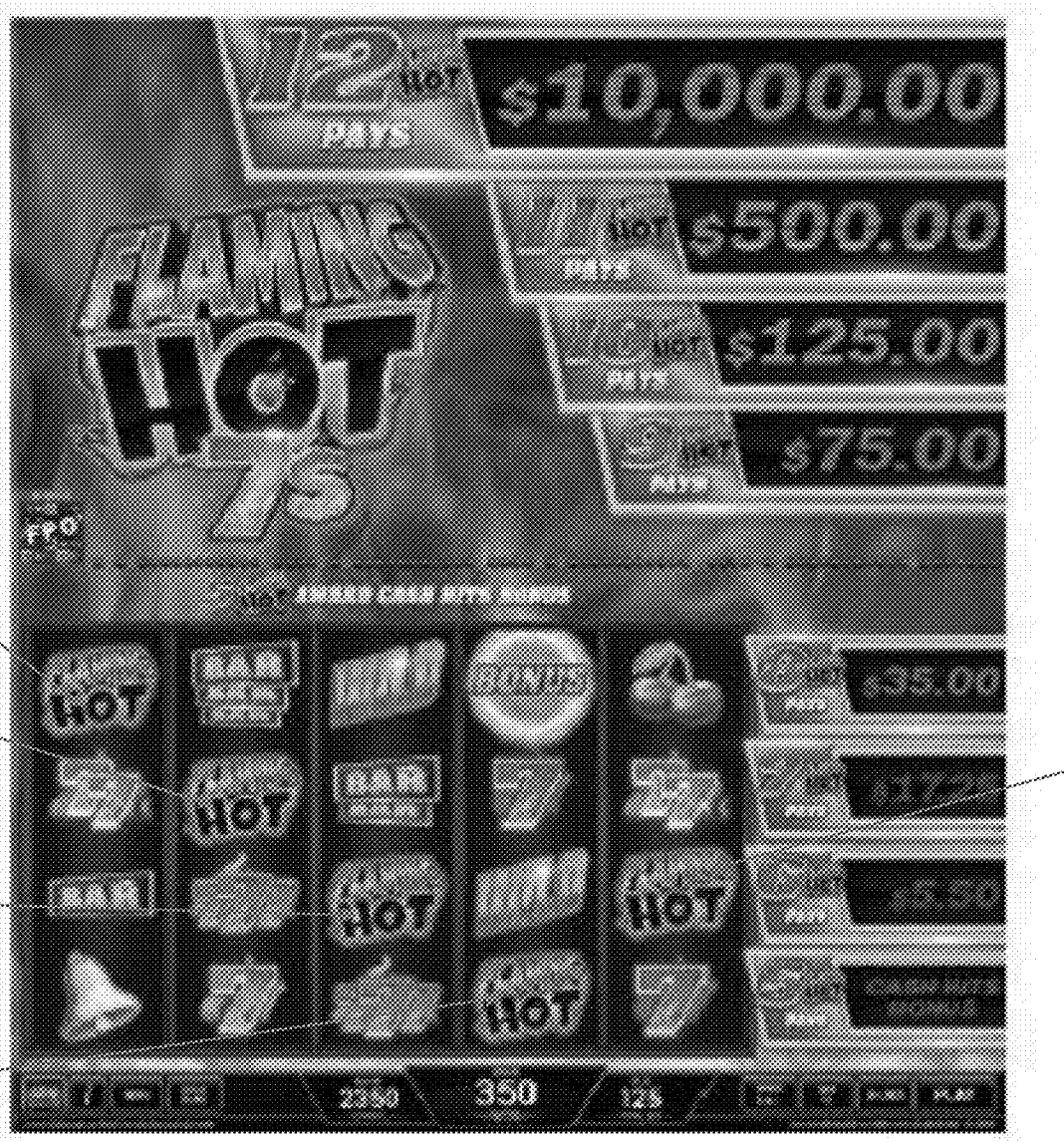
FIGS. 5A through 5W illustrate a series of screen shots depicting a first bonus game facilitated by the video slot machine according to the embodiments of the present invention.
Figure 5B:
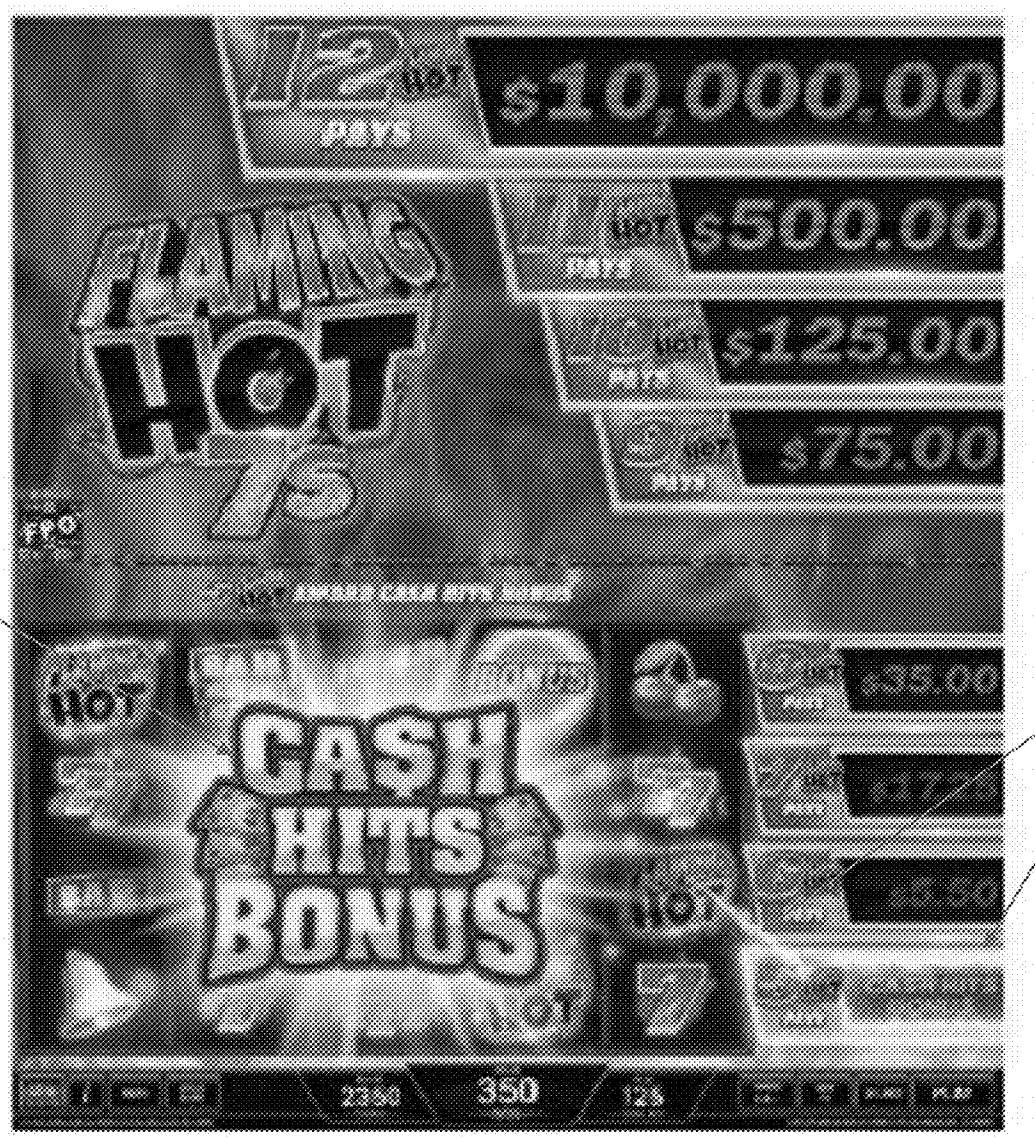
Figure 5C:
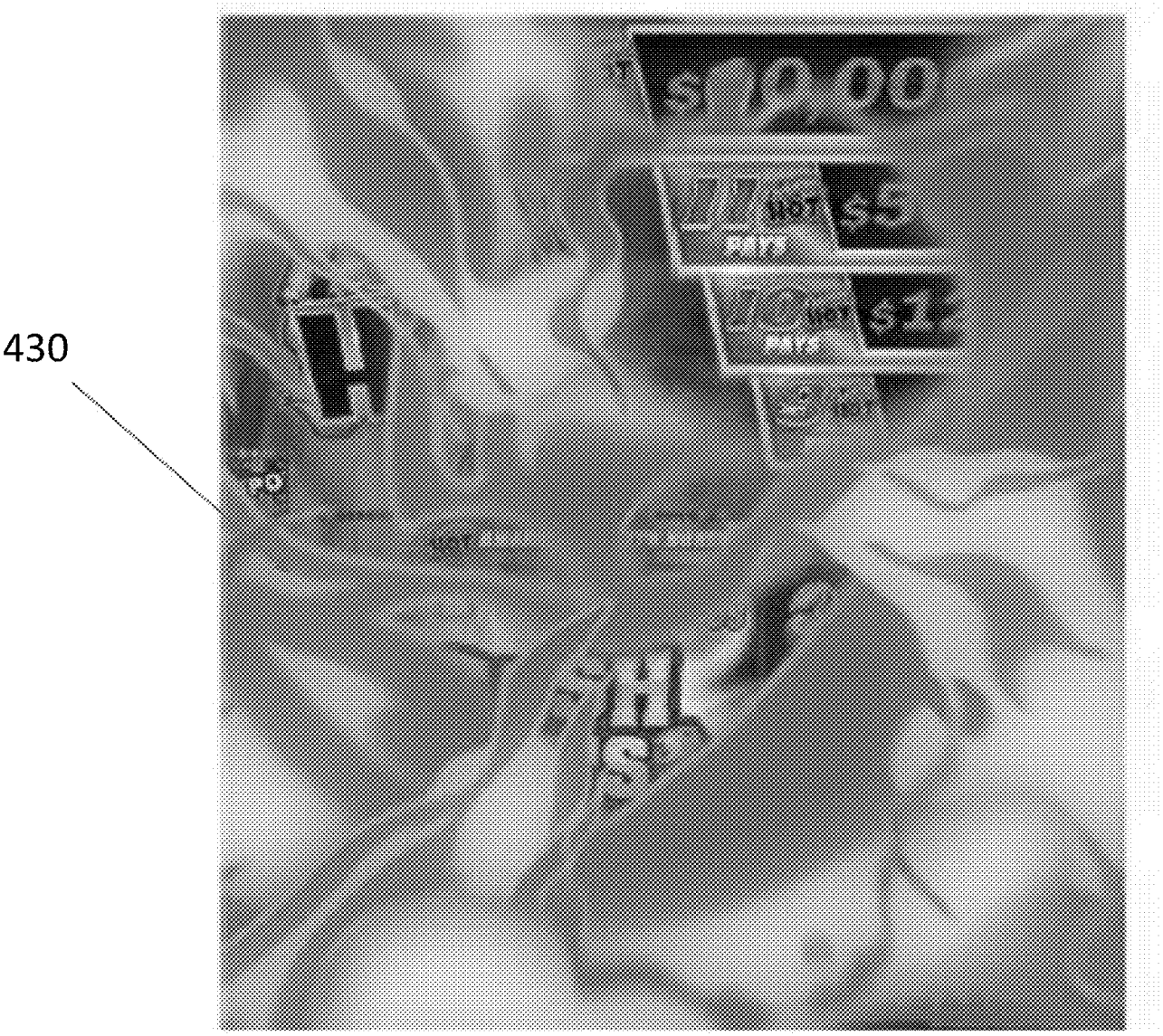
Figure 5D:
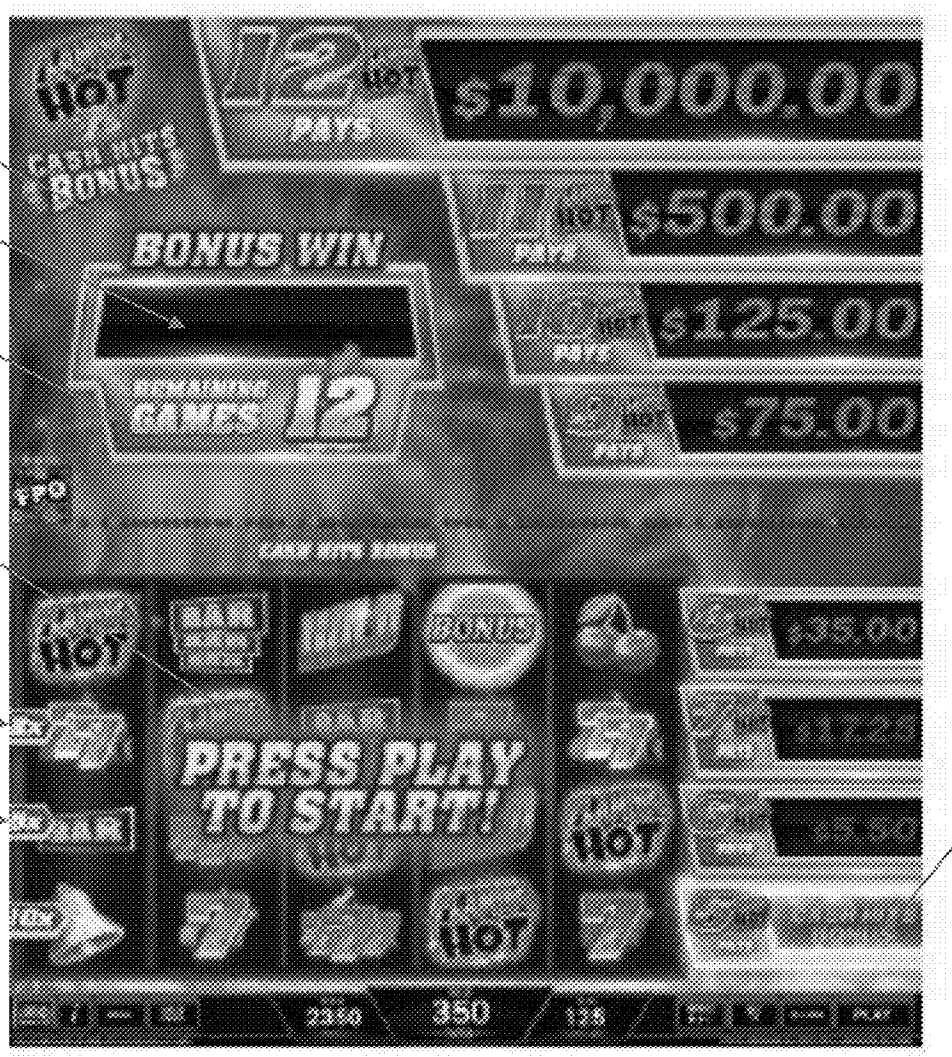
Figure 5F:
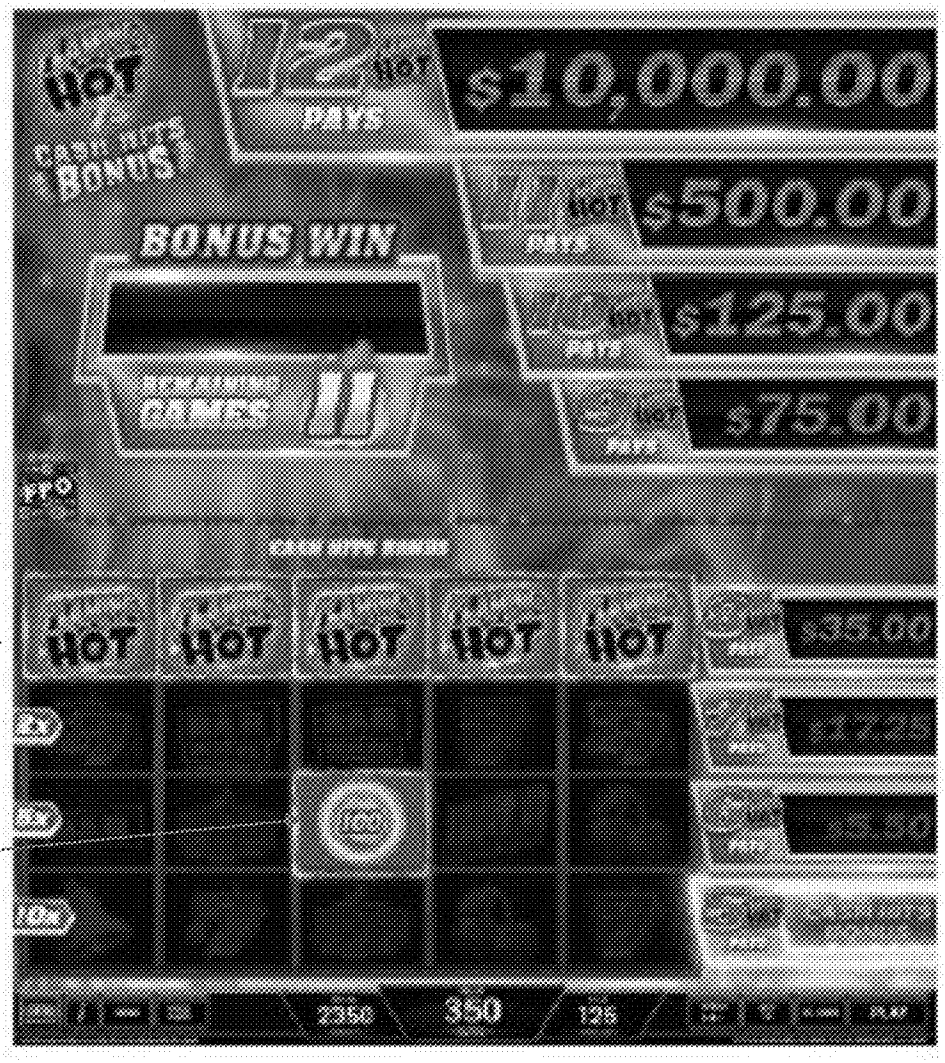
Figure 5G:
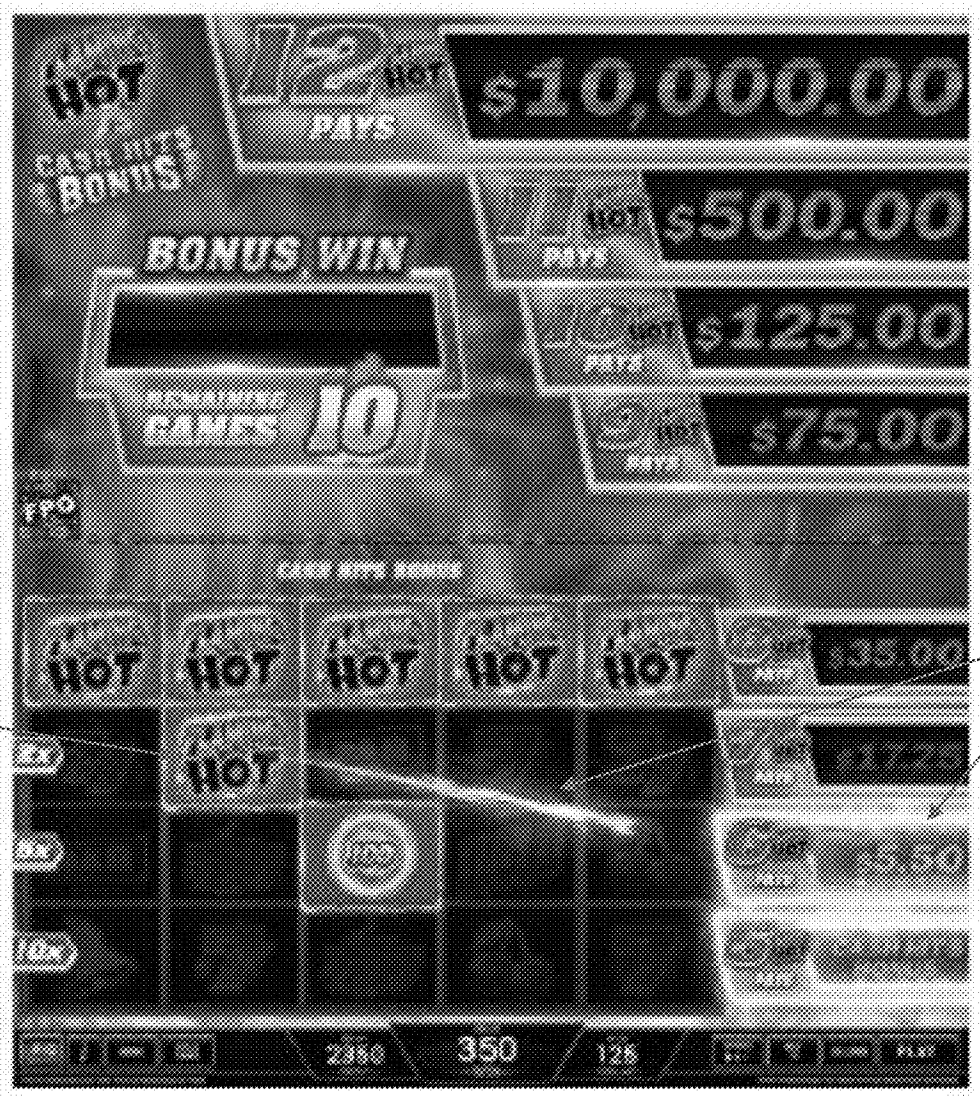
Figure 5I:
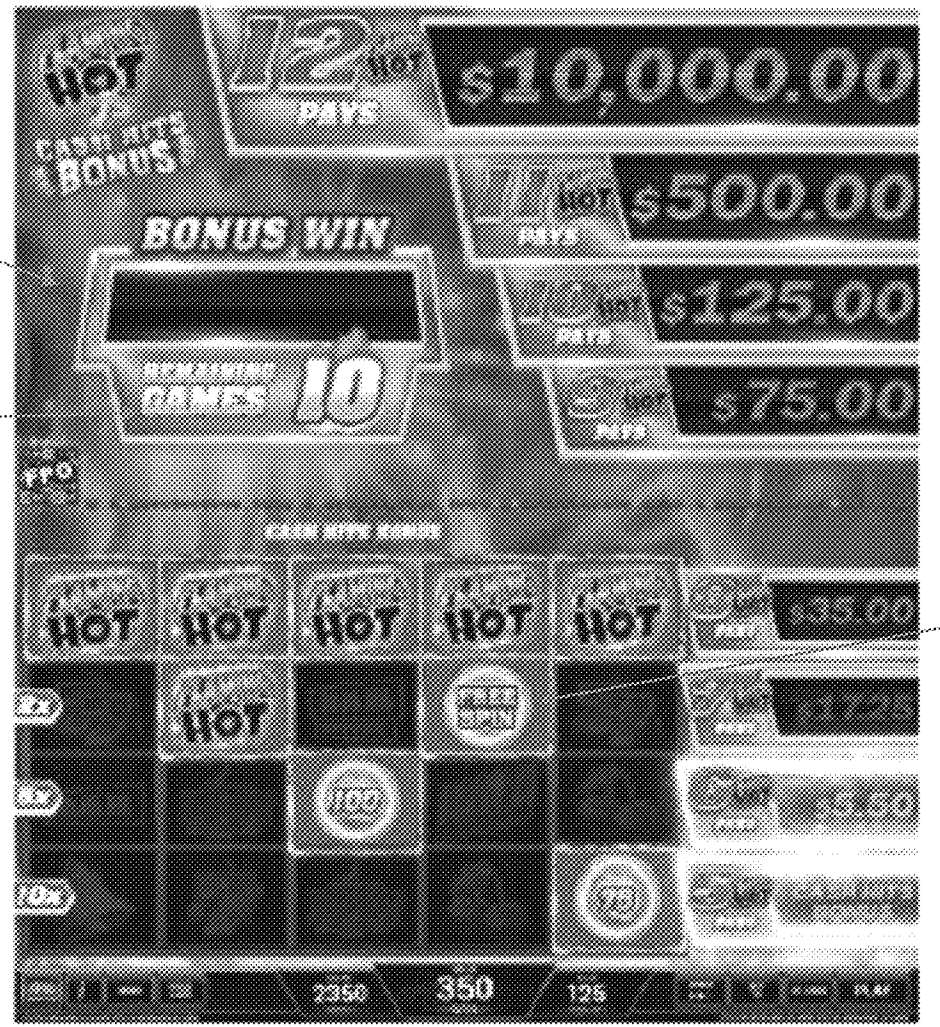
Figure 5L:
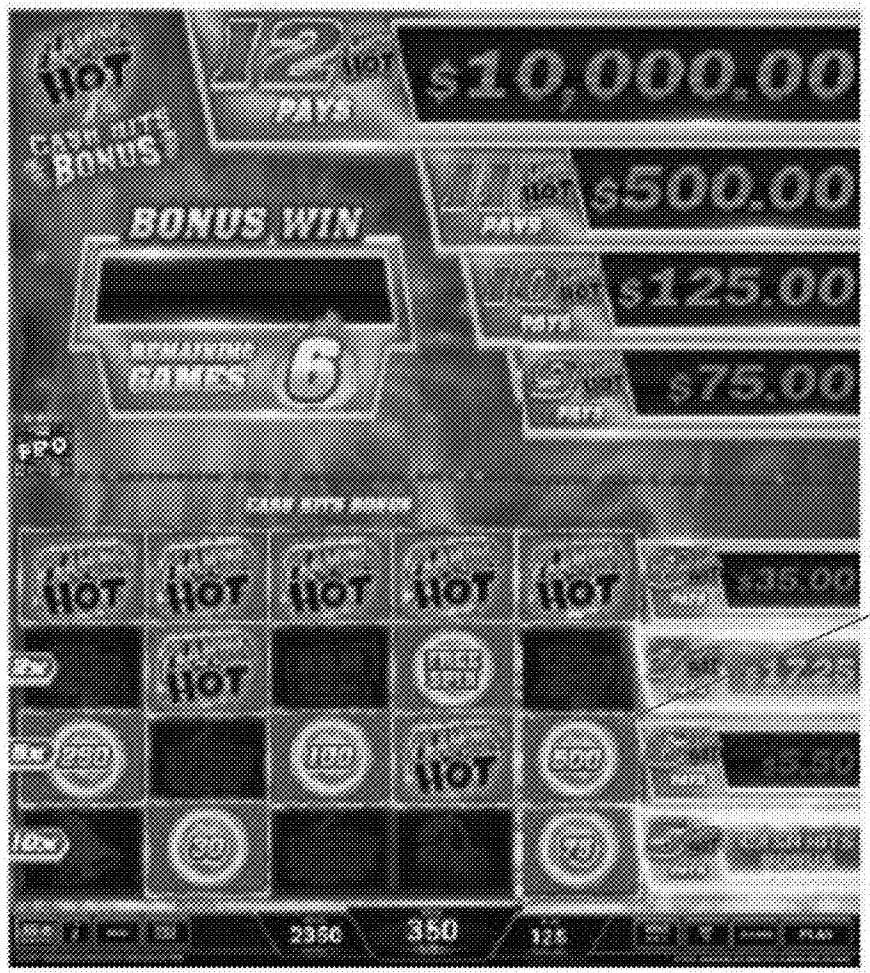
Figure 5M:
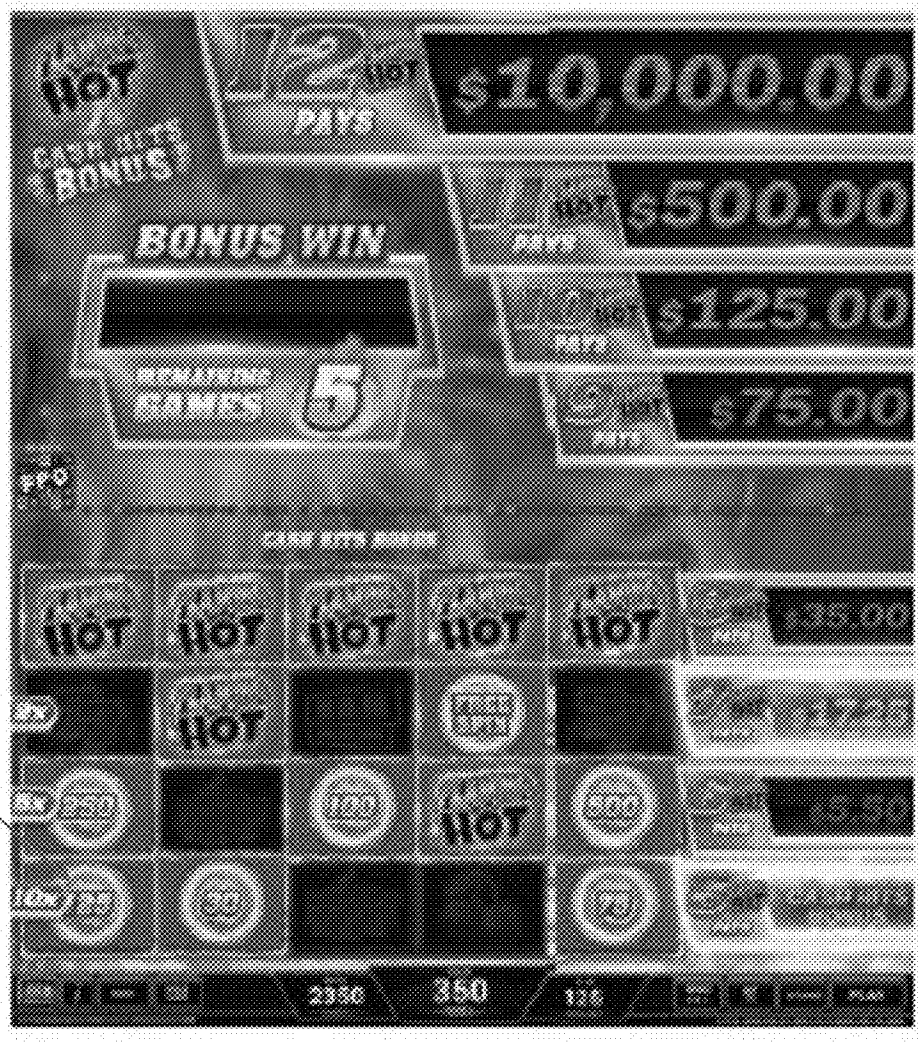
Figure 5P:
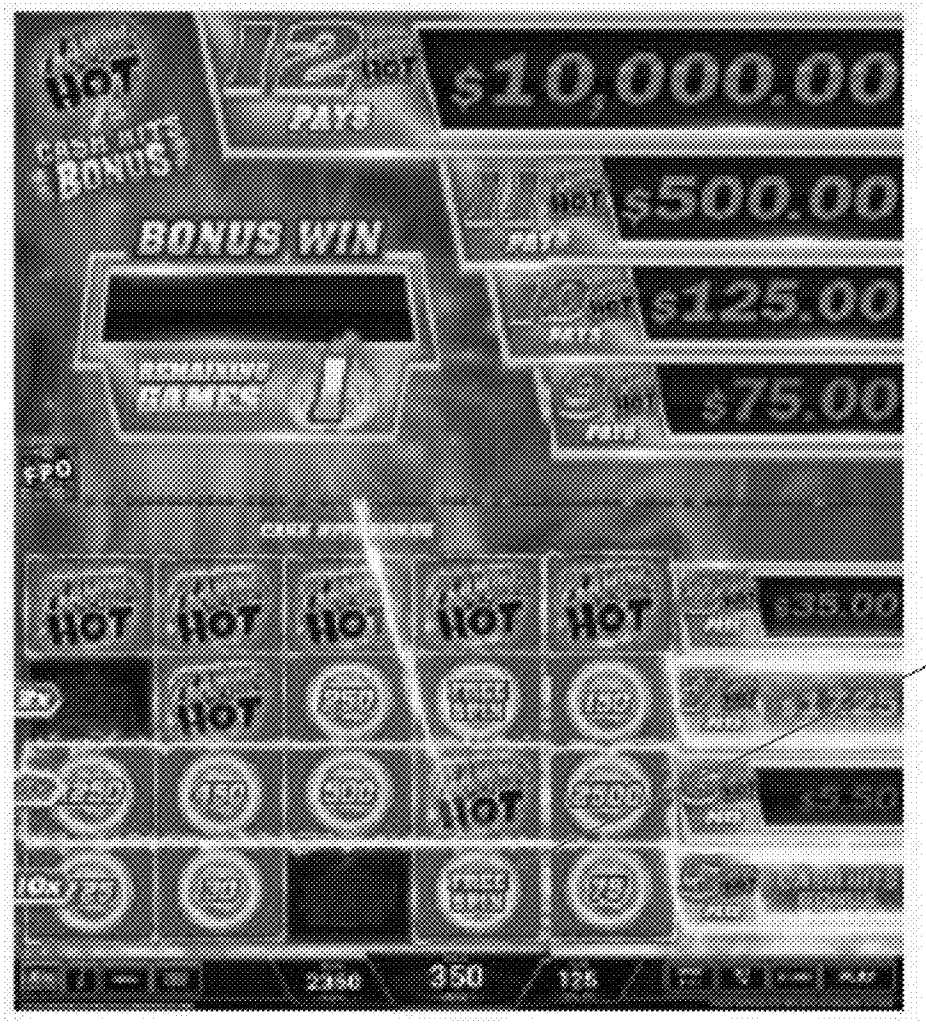
Figure 5Q:
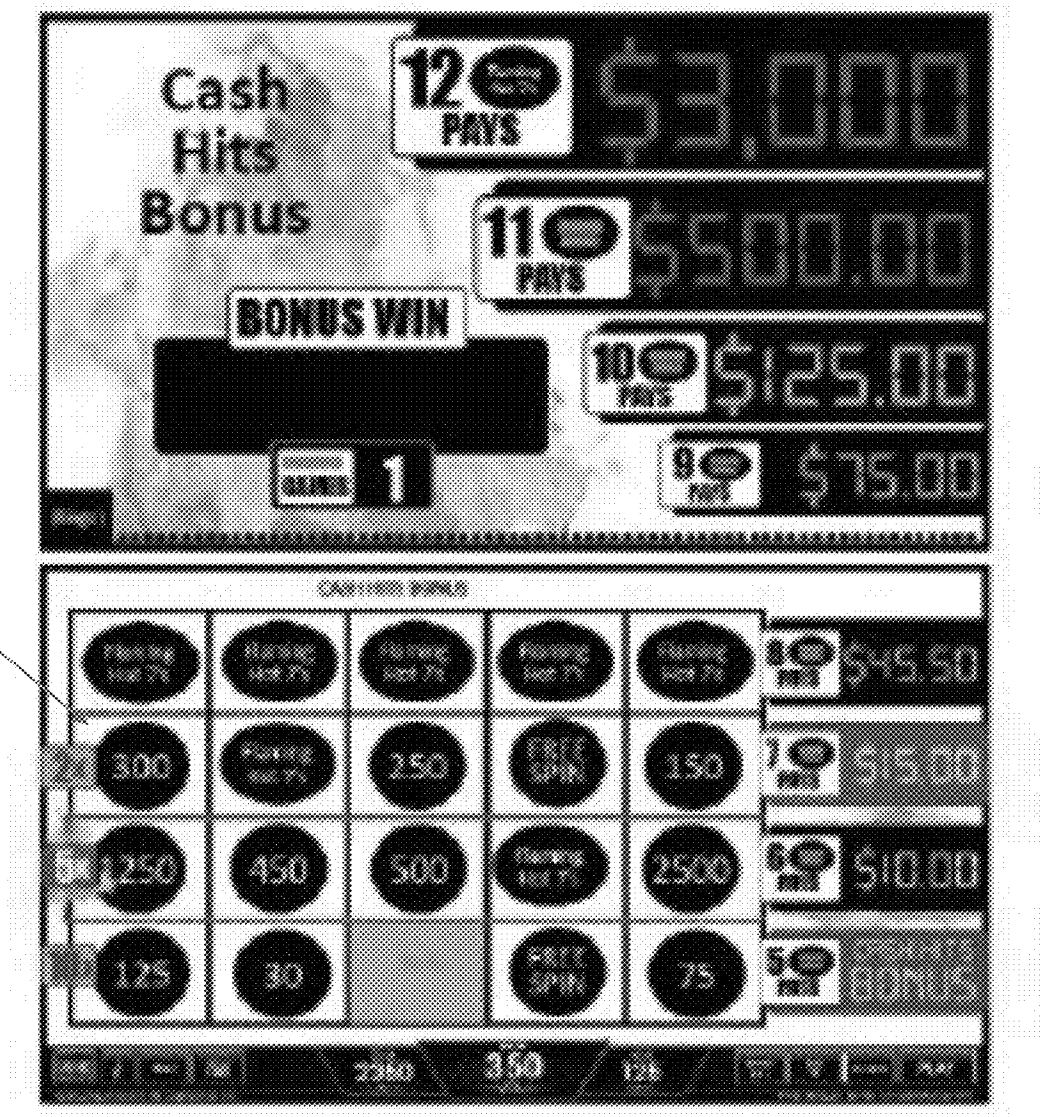
Figure 5W:
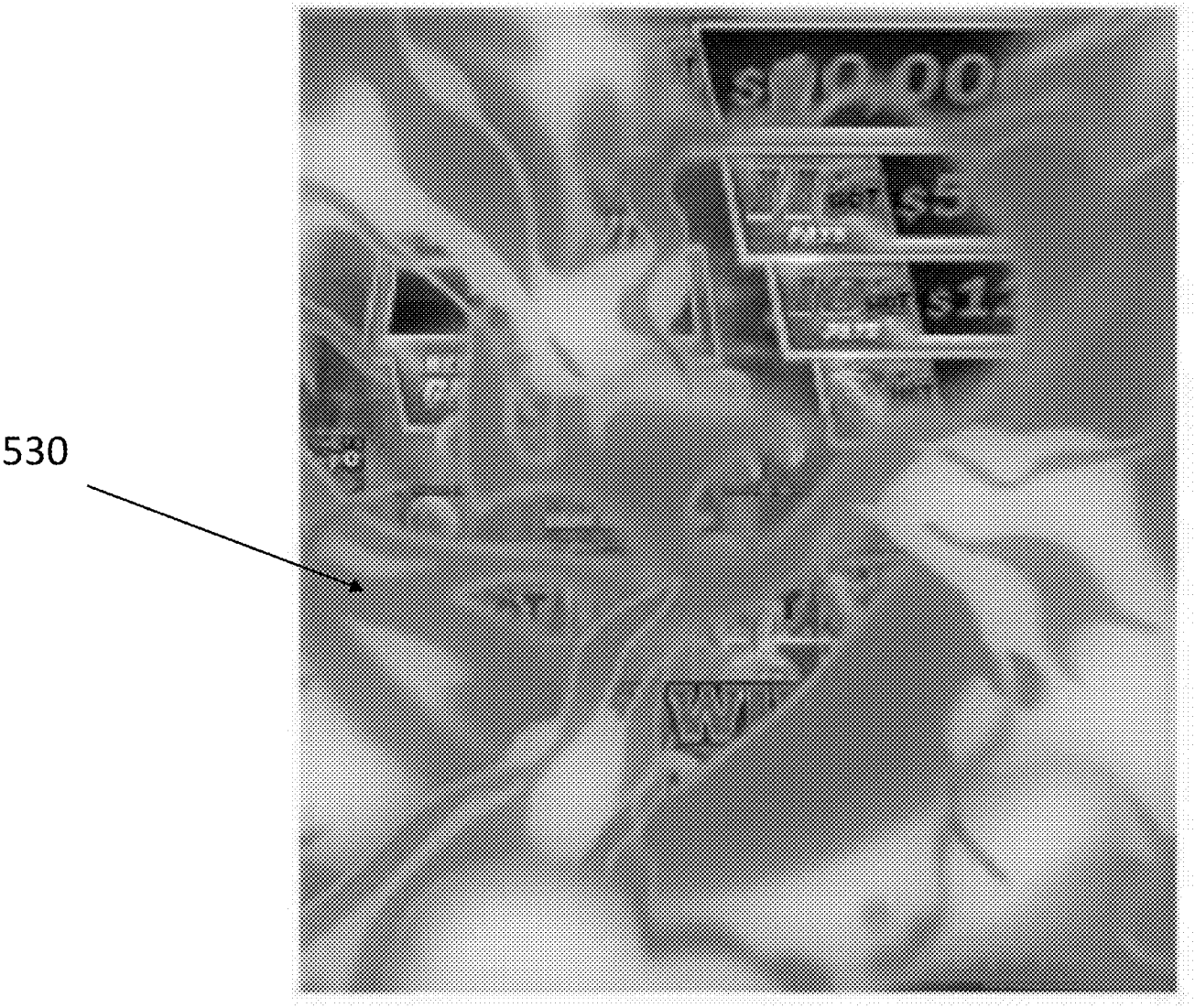

FIGS. 5A through 5W illustrate a series of screen shots depicting a first bonus game facilitated by the video slot machine according to the embodiments of the present invention. In one embodiment, as shown in FIG. 5A, five "Flaming Hot" symbols 415-1 through 415-5 appearing on any reels 405-1 through 405-5 triggers a Cash Hits bonus game as set forth within the payout structure depicted on the video slot machine display. To immediately and clearly notify the player of the Cash Hits bonus game, a Cash Hits bonus message 420, along with a fire bolt 425 identifying the award, appears on the video slot machine display. FIG. 5C shows optional fire transition animation 430 causing the game to move into the Cash Hits bonus game interface 435 depicted in FIG. 5D. A Cash Hits bonus game win meter 440 tracks the number of free bonus games remaining 442 and bonus amounts 444 accumulated during the bonus game. The Cash Hits bonus game interface 435 also introduces a multiplier 445-1 through 445-3 corresponding to three rows, namely rows 2, 3 and 4, of the video reel matrix formed of the five video reels 405-1 through 405-5 and four spaces defined by each video reel 405-1 through 405-5. A Press Play to Start message 450 appears on the slot machine video display to prompt play of the Cash Hits bonus game.

Once the player begins by pressing the play button, row one 455 of the video slot machine/device is populated with "Flaming Hot" symbols as shown in FIG. 5F. In one embodiment, the "Flaming Hot" symbols move to row one from the bottom of the slot machine video display as depicted by the arrows in FIG. 5E. Simultaneously with the dynamic populating of row 455 one with "Flaming Hot" symbols 415, each video reel 405-1 through 405-5 begins to independently spin. In this Cash Hits bonus game, the reels 405-1 through 405-5 depict either bonus coins, "Flaming Hot" symbols, or darkened spaces.

FIG. 5F shows the video slot machine display after one Cash Hits bonus game play. As shown, after the initial spin, a 100-credit bonus coin 460 has landed on the space defined by row 3 and reel 3. FIG. 5G shows a "Flaming Hot" symbol 415 landing on the space defined by row 2 and reel 2. The "Flaming Hot" symbol 415 in combination with the 5 "Flaming Hot" symbols populating row one, results in six "Flaming Hot" symbols causing a fire bolt 465 to identify the payout ($5.50) for six "Flaming Hot" symbols. FIG. 5H shows a 75-credit bonus coin 470 has landed on the space defined by row 4 and reel 5. FIG. 5I shows a Free Spin icon 475 landing on the space defined by row 2 and reel 4 after a fourth Cash Hits bonus spin. As a result, the Cash Hits bonus win meter 440 adds another bonus game changing from 9 games remaining to 10 games remaining. FIG. 5J shows a "Flaming Hot" symbol 480 landing on the space defined by row 3 and reel 4 after a sixth Cash Hit bonus spin/play. The "Flaming Hot" symbol 415 in combination with the six "Flaming Hot" symbols populating row one and the "Flaming Hot" symbol on the space defined by row 2 and reel 2 results in seven "Flaming Hot" symbols causing a fire bolt 485 to identify the payout ($17.25) for seven "Flaming Hot" symbols. FIG. 5K shows a 30-credit coin 490 landing on the space defined by row 4 and reel 2. FIG. 5L shows a 500-credit coin 495 landing on the space defined by row 3 and reel 5. FIG. 5M shows a 125-credit coin 500 landing on the space defined by row 4 and reel 1. FIG. 5N shows a 90-credit coin 505 landing on the space defined by row 3 and reel 2 as a result row three is locked (all row spaces filled) and the 3× multiplier is activated. FIG. 5O shows a 150-credit coin 510 has landed on the space defined by row 2 and reel 5. FIG. 5P shows a Free Spin icon 515 landing on the space defined by row 4 and reel 4. FIG. 5Q shows a 300-credit coin 520 landing on the space defined by row 2 and reel 1 and, as shown in FIG. 5R, row two is locked (all row spaces filled) and the 2× multiplier is activated. FIG. 5S shows a final video slot machine display after all spins have been used as shown by the Cash Hit bonus win meter 440.

FIGS. 5T and 5U show bonus award totals 520, 525 being aggregated on the Cash Hit bonus win meter 440. FIG. 5V shows a final Cash Hit bonus with 0 games remaining and a total bonus win of 7880 coins 525. FIG. 5W shows optional fire transition animation 530 causing the game to exit the Cash Hit bonus game 435 and returning to the primary game.

Figure 6A:
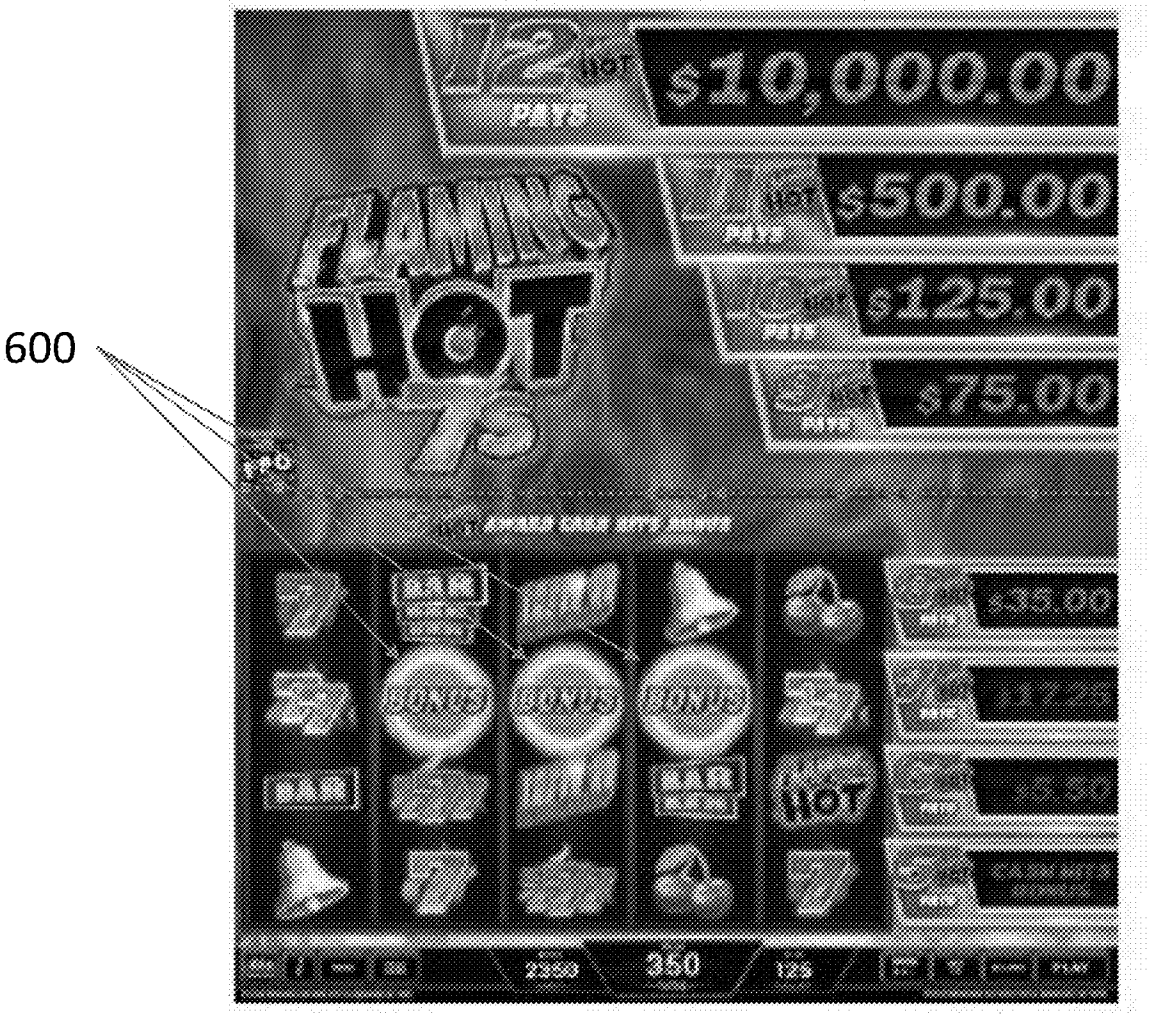
Figure 6B:
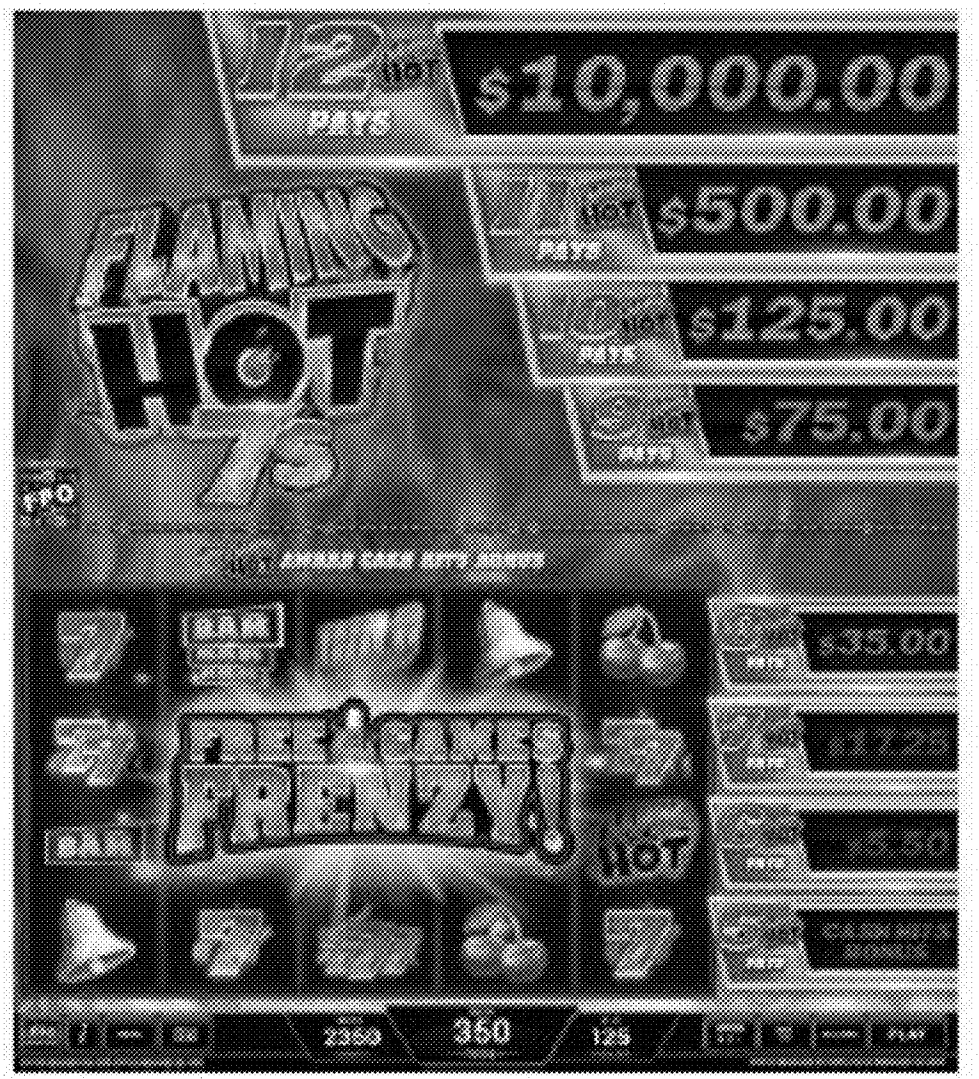
Figure 6C:
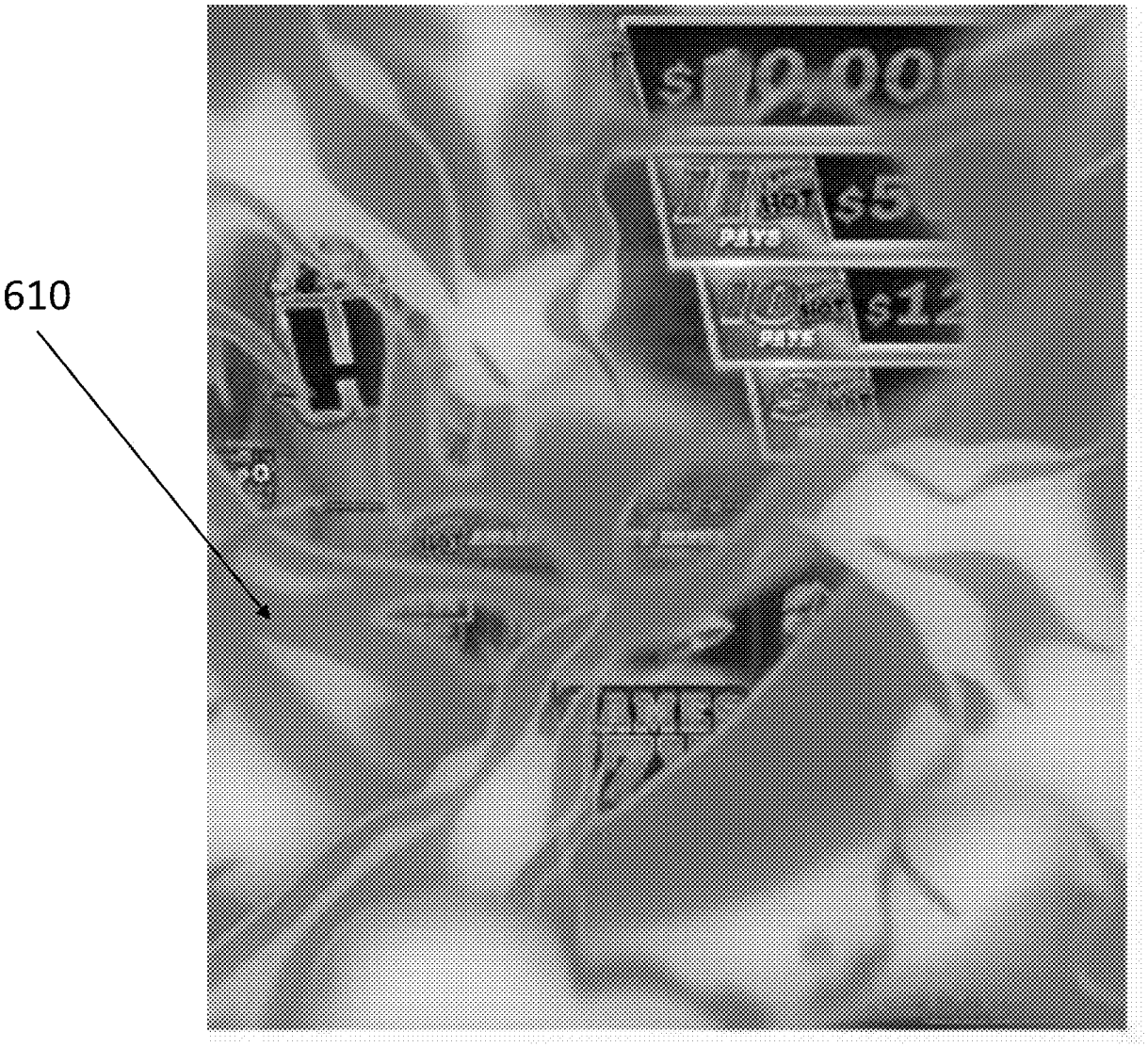
Figure 6D:
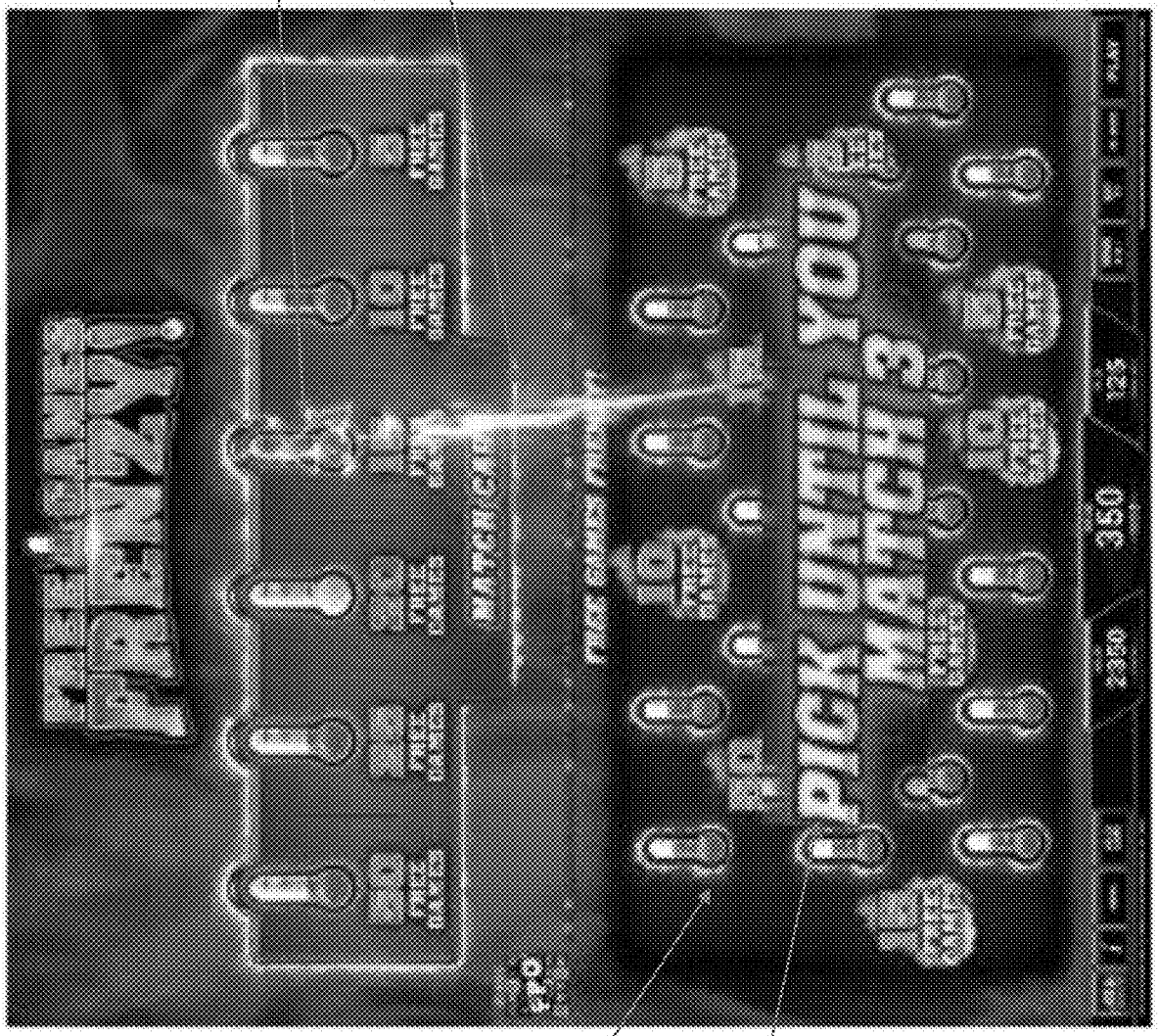
Figure 6E:
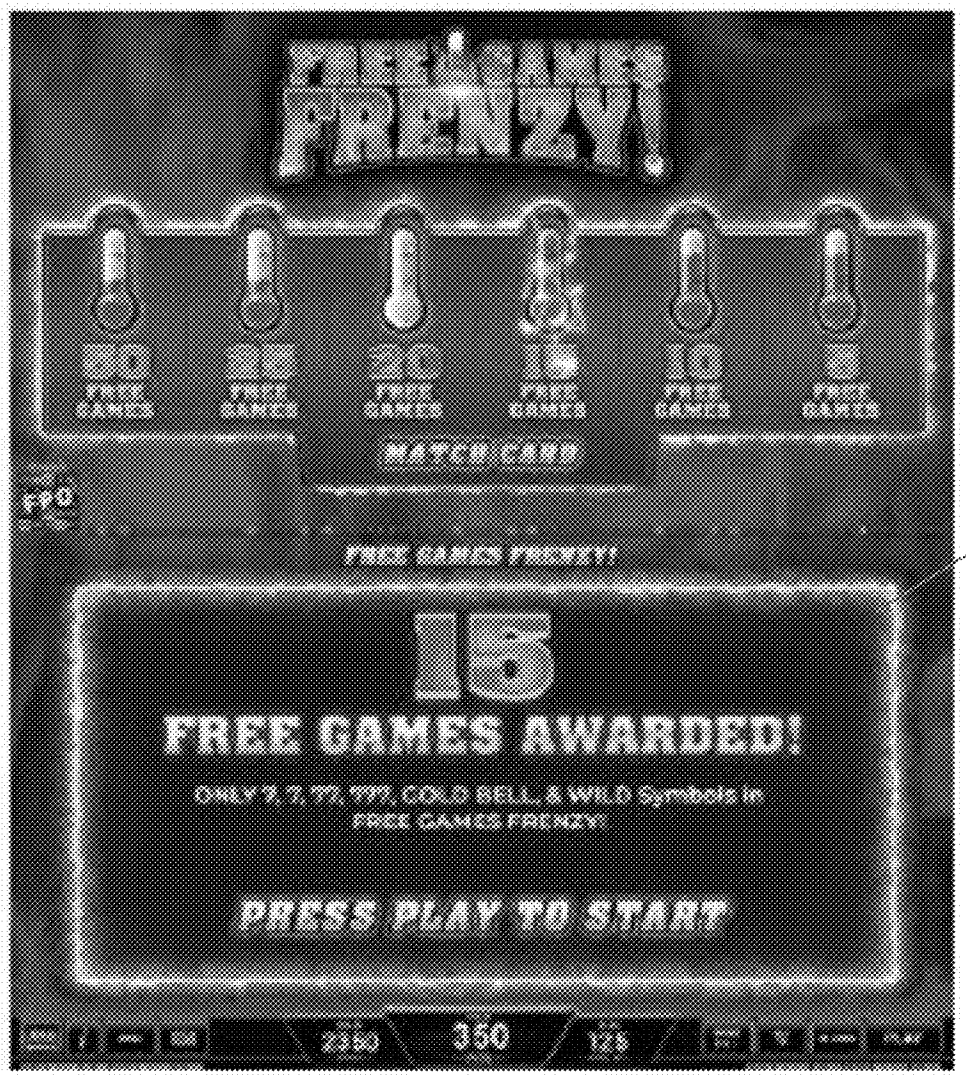
Figure 6F:
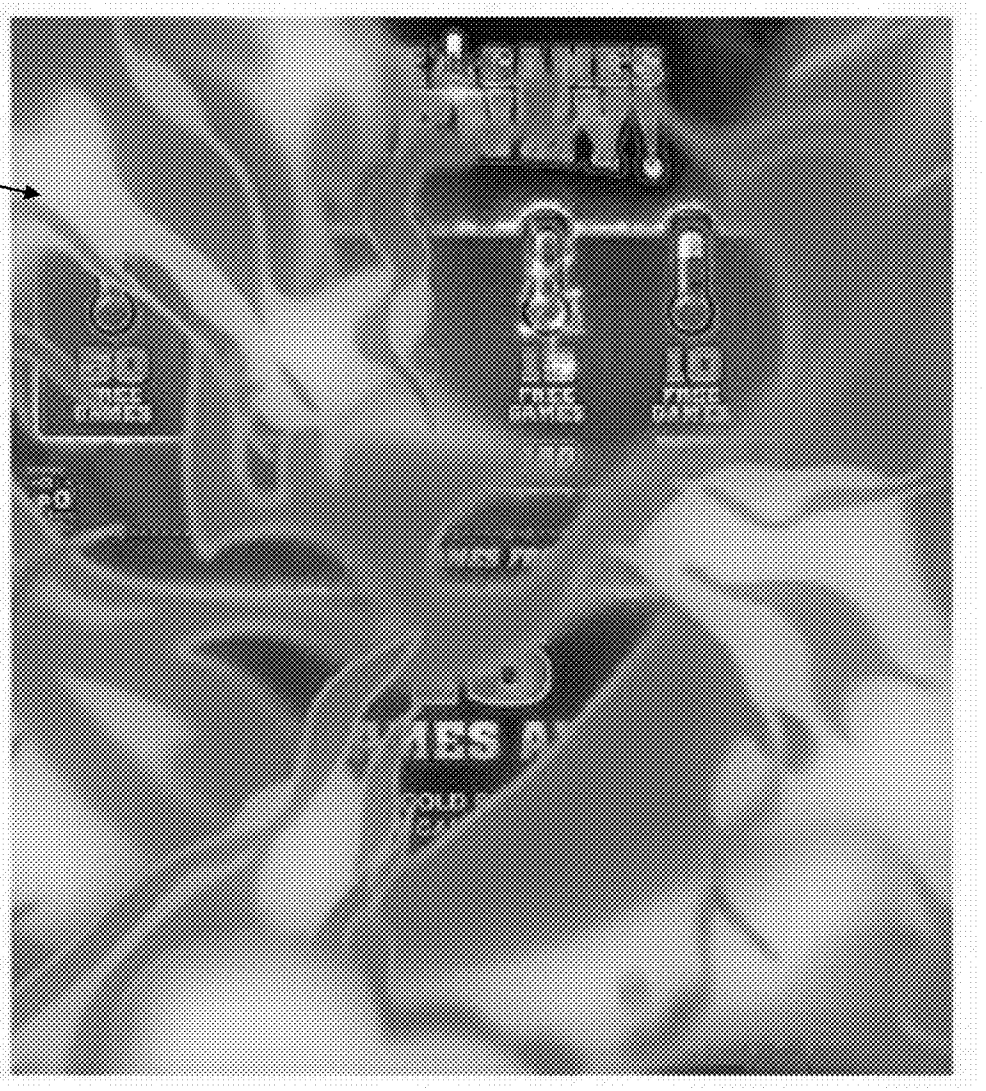
Figure 6G:
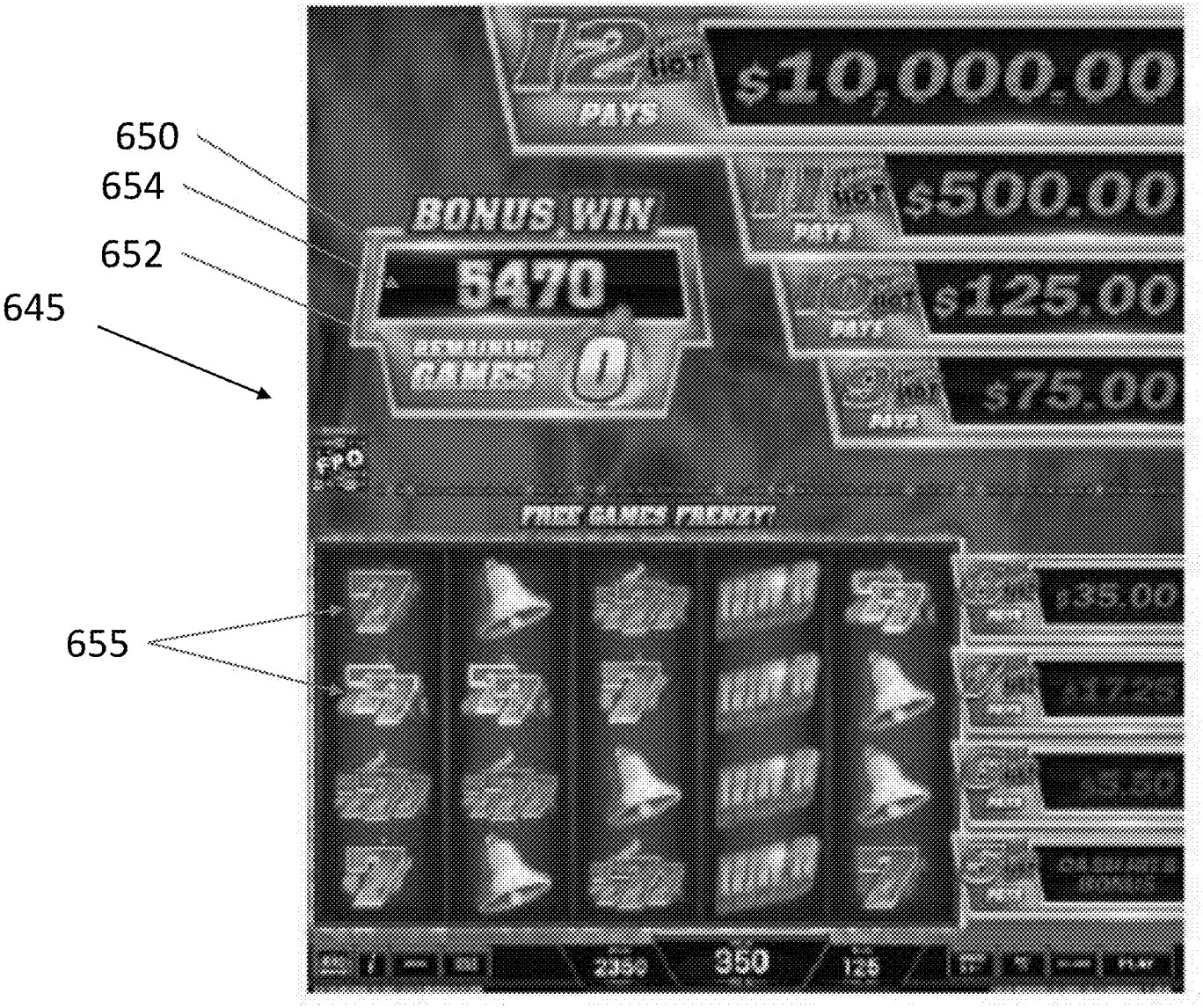
Figure 6I:
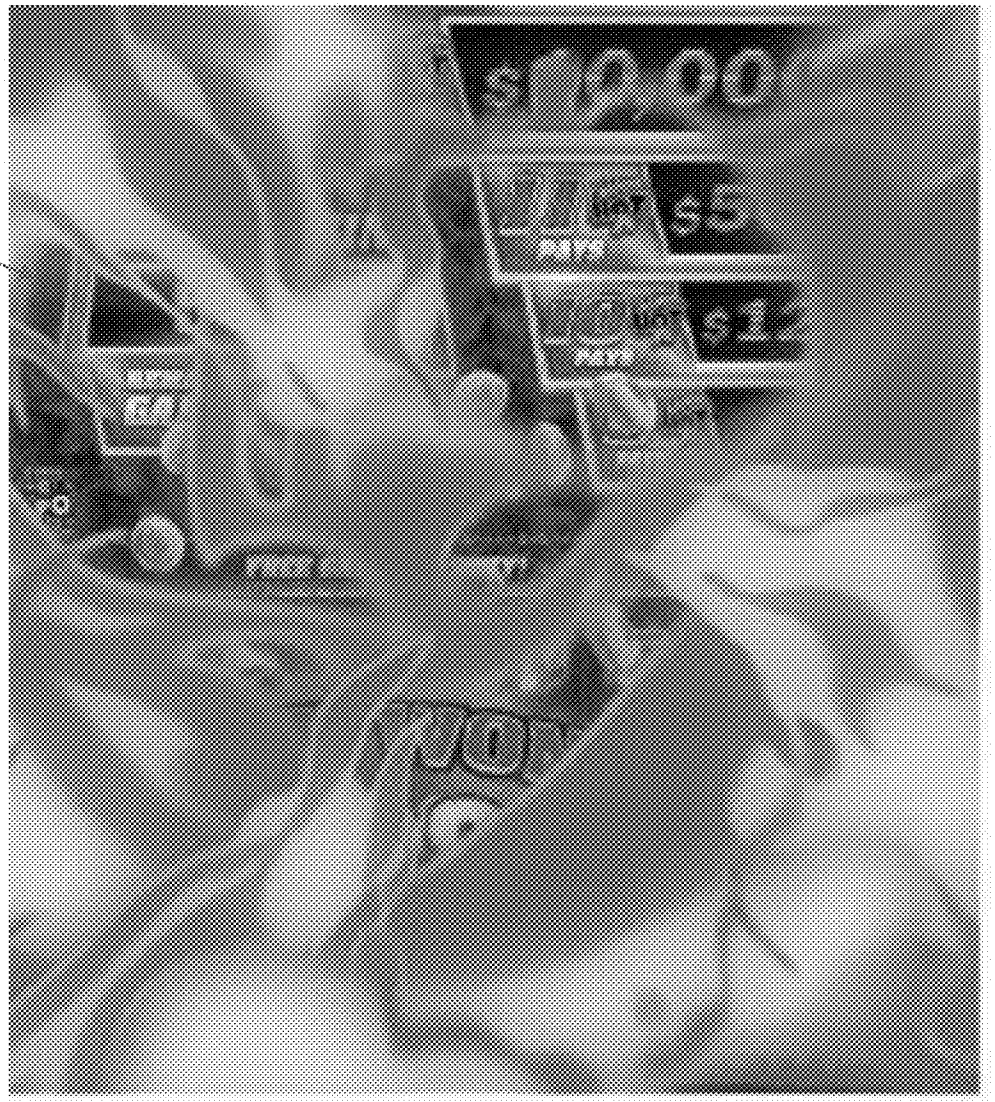

FIGS. 6A through 6I illustrate a series of screen shots depicting a second bonus game facilitated by the video slot machine according to the embodiments of the present invention. In this embodiment, three or more Bonus Symbols 600 scattered on the screen trigger a Free Game bonus. Free Game bonus message 605 notifies the player of the same. FIG. 6C shows optional fire transition animation 610 causing the presentation of a Free Game bonus interface 615 depicted in FIG. 6D. In one embodiment, the thermometers 620 pulsate along with the initial Pick Until You Match 3 message 625 indicating a need for the player to select a plurality of the same. FIG. 6D shows the player has matched three bonus win amounts corresponding to 15 free games 630 as identified by the fire bolt 635. FIG. 6E shows a 15 Free Game Won 640 message. FIG. 6F shows optional fire transition animation 640 causing the presentation of a Bonus Game interface 645 depicted in FIG. 6G. The Bonus Game interface 645 includes a Bonus win meter 650 for tracking the number of bonus games remaining 652 and bonus amounts 654 accumulated during the bonus game. In this embodiment, the bonus game symbols 655 are a pared down version of the game symbols used in the primary game. In one embodiment, the selected symbols comprise the 7 symbols, gold bell symbol and wild symbols such that each bonus game outcome results in a win. FIG. 6H shows the Bonus win meter 654 depicting that the player won 5470 coins during the 15 free spins during the bonus game. FIG. 6I shows optional fire transition animation 655 causing the game to return to the primary game.

Figure 7:
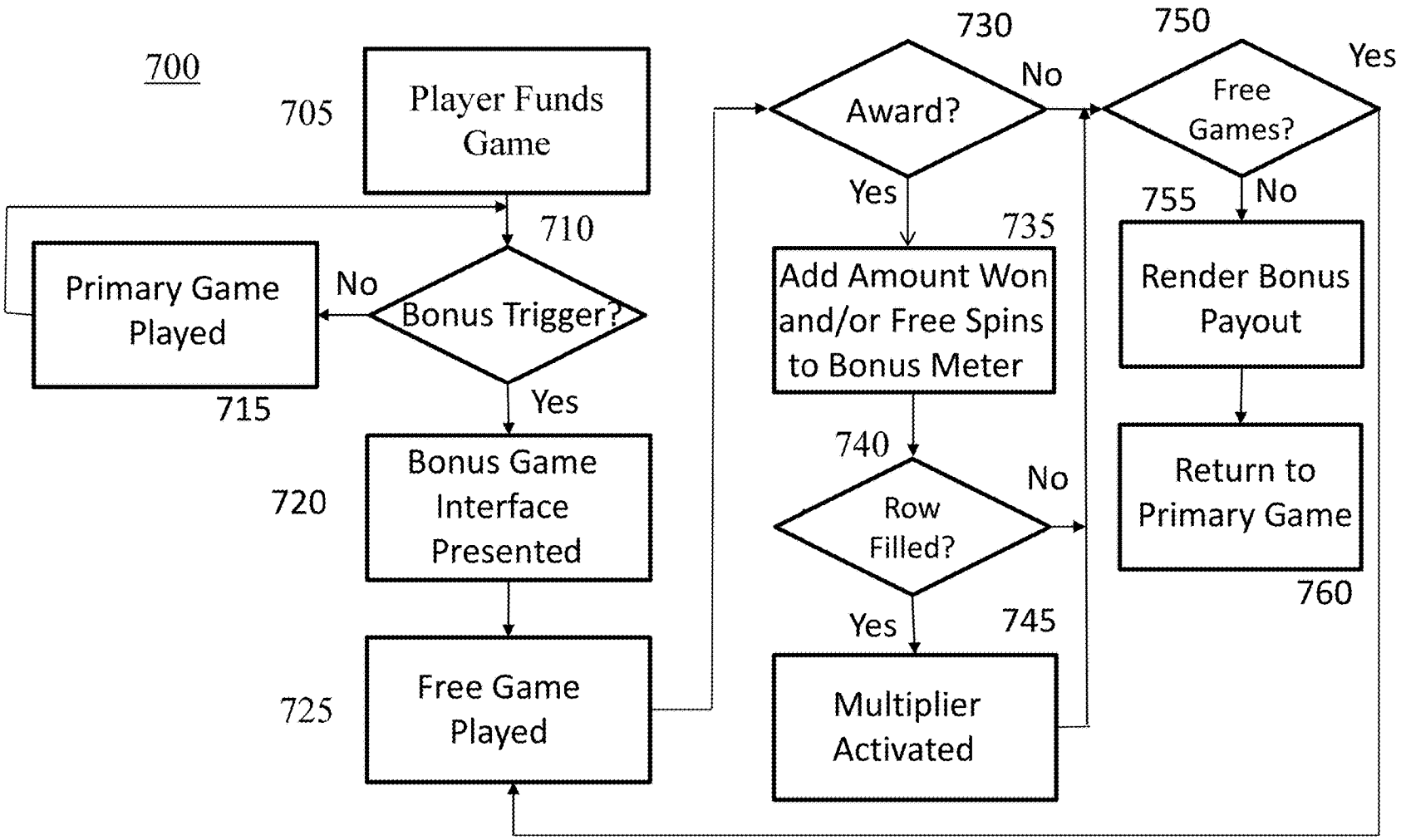
FIG. 7 illustrates a flow chart detailing the first bonus game facilitated by the video slot machine according to the embodiments of the present invention.

FIG. 7 illustrates a flow chart 700 detailing the first bonus game facilitated by the video slot machine according to the embodiments of the present invention. This first bonus game involves winning free bonus game spins based on one or more primary game outcomes. At 705, the player funds the game. This may be accomplished by inserting a ticket, voucher, coupon, currency, coins, etc., into a video gaming machine. If the game is played online, a credit card, debit card or other means may be used to fud the game. At 710, it is determined if there is a bonus game trigger (e.g., five "Flaming Hot" symbols on the screen). If not, at 715, the primary game is played again. If, at 710, there is a bonus trigger, at 720, the bonus game interface is presented on the video game display. At 725, a first free bonus game is played (in one embodiment, the free bonus game spins may be automatically triggered by the processor). At 730, it is determined if there is a bonus award resulting from the free bonus game spin. If so, at 735, the bonus award amount and/or free spin (or any other award) is added to a bonus game meter. At 740, it is determined if any row is filled with symbols. If so, at 745, a corresponding row multiplier is activated. If, at 730, there is no bonus award won, at 750, it is determined if any free bonus games remain. If not, at 755, the bonus payout, including the application of any multipliers, is made, and at 760, the player returns to the primary game. If, at 750, there are free bonus games remaining, the flow chart 700 loops back to 725.

Figure 8:
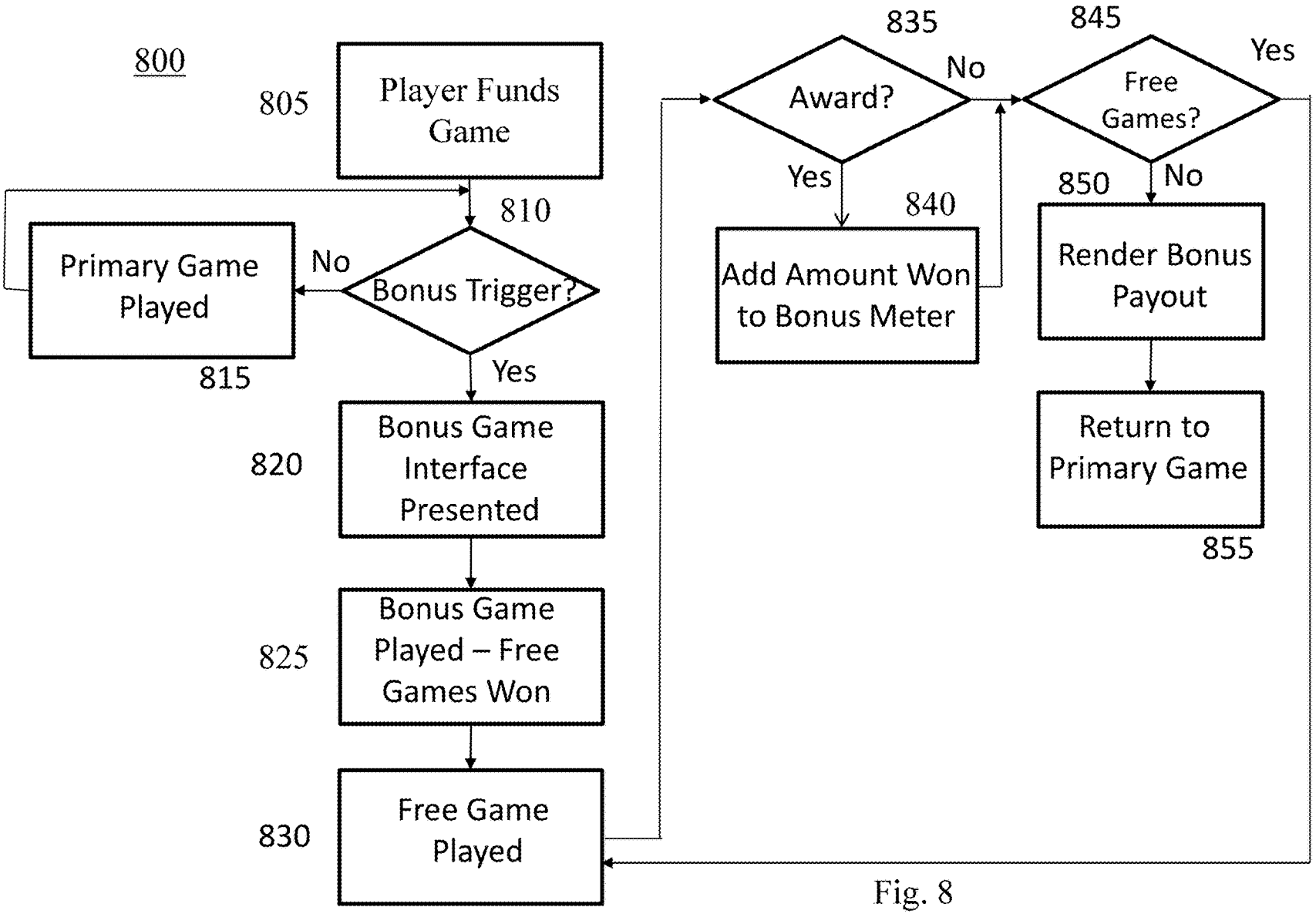
FIG. 8 illustrates a flow chart detailing the second bonus game facilitated by the video slot machine according to the embodiments of the present invention.

FIG. 8 illustrates a flow chart 800 detailing the second bonus game facilitated by the video slot machine according to the embodiments of the present invention. This second bonus game involves winning free spins of a bonus game within the bonus game. At 805, the player funds the game. This may be accomplished by inserting a ticket, voucher, coupon, currency, coins, etc., into a video gaming machine. If the game is played online, a credit card, debit card or other means may be used to fud the game. At 810, it is determined if there is a bonus game trigger (e.g., three aligned bonus symbols in the primary game on the screen). If not, at 815, the primary game is played again. If, at 810, there is a bonus trigger, at 820, the bonus game interface is presented on the video game display. At 825, a bonus game is played with a certain number of free spins being awarded. In one embodiment, the initial bonus game is a matching style game but those skilled in the art will recognize that any bonus style bonus game may be utilized to award the free spins. At 830, a first free bonus game is played (in one embodiment, the free bonus game spins may be automatically triggered by the processor). At 835, it is determined if there is a bonus award resulting from the free spins of the bonus game. If so, at 840, the award amount and/or free spins (or any other award) is added to a bonus game meter. If, at 835, there is no bonus award won, at 845, it is determined if any free bonus games remain. If not, at 850, the bonus payout, is made, and at 855, the player returns to the primary game. If, at 845, there are free bonus games remaining, the flow chart 800 loops back to 830.

Although the invention has been described in detail with reference to several embodiments, additional variations and modifications exist within the scope and spirit of the invention as described and defined in the following claims.

I claim:

1. A computer-implemented gaming device comprising:

a monetary input device configured to receive a physical item associated with a monetary value;

a user interface configured to:

enable a player to select a wager for a game of chance and enable the player to initiate a cash out operation;

at least one processor running executable instructions related to a game of chance;

said at least one processor programmed to:

add said monetary value to a credit balance for said player;

deduct said selected wager from said credit balance; and decrease said credit balance in response to said cash out operation;

a display configured to depict said casino game in video format;

a primary game user interface configured to receive one or more game play instructions from a player;

memory in communication with said at least one processor, said memory retaining certain game play or game outcome features;

wherein said processor is configured to conduct said casino game utilizing multiple video reels on said display, each of said multiple reels depicting multiple game symbols, said processor further configured to randomly generate primary game outcomes involving said multiple game symbols, said processor further configured to identify a certain number of pre-established bonus game triggering symbols appearing on said display, said processor further configured to award a pre-established number of free bonus game spins and present a bonus game interface responsive to said certain number of pre-established bonus game triggering symbols appearing on said display; and wherein said processor is further configured to control a bonus game by utilizing said multiple video reels on said display and pre-populating certain of said spaces defined by said video reels with said certain number of pre-established bonus game triggering symbols appearing on said display to trigger said bonus game, said processor configured to allow said player to play said bonus game based on said pre-established number of free bonus game spins during which a bonus set of game symbols is depicted on said video reels, and wherein after each successive bonus game spin at least one bonus game symbol remains displayed in a space of one of said video reels such that over multiple bonus game spins said reel spaces are populated with bonus game symbols whereby any row of spaces being filled with bonus game symbols after said multiple bonus game spins triggers a row multiplier, said multiplier applied to amounts depicted by the bonus game symbols populating said row.

2. The gaming device of claim 1 wherein said video reels number five, each video reel defining four spaces.

3. The gaming device of claim 2 wherein said processor is further configured to award a pre-established number of free bonus game spins and present a bonus game interface responsive to five pre-established bonus game triggering symbols appearing on said display.

4. The gaming device of claim 2 wherein said processor is further configured to pre-populate a first row of five spaces defined by said five video reels with pre-established bonus game triggering symbols.

5. The gaming device of claim 1 wherein said processor is further configured to award twelve free bonus game spins.

6. The gaming device of claim 2 wherein rows two, three and four each have an assigned multiplier during play of said bonus game.

7. The gaming device of claim 1 wherein said processor is further configured to cause a bonus win meter to be displayed during play of said bonus game, said bonus win meter tracking an aggregate bonus amount won and a number of free bonus spins remaining.

8. A computer-implemented gaming device comprising:

a monetary input device configured to receive a physical item associated with a monetary value;

a user interface configured to:

enable a player to select a wager for a game of chance and enable the player to initiate a cash out operation;

at least one processor running executable instructions related to a game of chance;

said at least one processor programmed to:

add said monetary value to a credit balance for said player;

deduct said selected wager from said credit balance; and decrease said credit balance in response to said cash out operation;

a display configured to depict said casino game in video format;

a primary game user interface configured to receive one or more game play instructions from a player;

memory in communication with said at least one processor, said memory retaining certain game play or game outcome features;

wherein said processor is configured to conduct said casino game utilizing multiple video reels on said display, each of said multiple video reels depicting multiple primary game symbols, said processor further configured to randomly generate primary game outcomes involving said multiple game symbols, said processor further configured to identify a pre-established arrangement of pre-established bonus game triggering symbols appearing on said display, said processor further configured to present a bonus game interface responsive to said pre-established arrangement of pre-established bonus game triggering symbols appearing on said display;

wherein said processor is further configured to control a bonus game, said bonus game including two features, a first feature comprising a player interactive challenge configured to award a number of free bonus game spins and a second feature comprising said player undertaking said free bonus game spins whereby said processor is configured to automatically play said bonus game utilizing said video reels with a portion of said primary game symbols such that each free spin of the bonus game results in a win.

9. The gaming device of claim 8 wherein said video reels number five, each video reel defining four spaces.

10. The gaming device of claim 8 wherein said processor is further configured to present a bonus game interface responsive to three or more bonus game triggering symbols aligning along an active pay line.

11. The gaming device of claim 8 wherein said processor is further configured to cause a bonus win meter to be displayed during play of said bonus game, said bonus win meter tracking an aggregate bonus amount won and a number of free bonus spins remaining.

12. A computer-implemented gaming device comprising:

a monetary input device configured to receive a physical item associated with a monetary value;

a user interface configured to:

enable a player to select a wager for a game of chance and enable the player to initiate a cash out operation;

at least one processor running executable instructions related to a game of chance;

said at least one processor programmed to:

add said monetary value to a credit balance for said player;

deduct said selected wager from said credit balance; and decrease said credit balance in response to said cash out operation;

a display configured to depict said casino game in video format;

a primary game user interface configured to receive one or more game play instructions from a player;

memory in communication with said at least one processor, said memory retaining certain game play or game outcome features;

wherein said processor is configured to conduct said casino game utilizing multiple video reels on said display, each of said multiple reels depicting multiple game symbols, said processor further configured to randomly generate primary game outcomes involving said multiple game symbols, said processor further configured to present a bonus game interface responsive to one or more pre-established primary game outcomes; and wherein said processor is further configured to control a bonus game by utilizing said multiple video reels on said display wherein after each successive bonus game spin at least one bonus game symbol remains displayed in a space of one of said video reels such that over multiple bonus game spins said reel spaces are populated with bonus game symbols whereby any row of spaces being filled with bonus game symbols after said multiple bonus game spins triggers a pre-established row multiplier, said multiplier applied to amounts depicted by the bonus game symbols populating said row.

13. The gaming device of claim 12 wherein said video reels number five, each video reel defining four spaces.

14. The gaming device of claim 13 wherein at least one row has a multiplier.

15. The gaming device of claim 12 wherein said processor is further configured to cause a bonus win meter to be displayed during play of said bonus game, said bonus win meter tracking an aggregate bonus amount won and a number of free spins remaining.

* * * * *